US010934642B2

(12) United States Patent
Wörnle et al.

(10) Patent No.: US 10,934,642 B2
(45) Date of Patent: Mar. 2, 2021

(54) LOOP-FORMING METHOD AND DEVICE

(71) Applicants: Groz-Beckert KG, Albstadt (DE); Santoni S.P.A, Brescia (IT)

(72) Inventors: Martin Wörnle, Mössingen (DE); Jörg Sauter, Albstadt (DE); Uwe Stingel, Meßstetten (DE); Eric Jürgens, Bisingen (DE); Hans-Jürgen Haug, Mössingen (DE); Marco Andreoli, Castegnato Brescia (IT); Stefano Rizzi, Brescia (IT)

(73) Assignee: Groz-Beckert KG, Albstadt (DE)

( * ) Notice: Subject to any disclaimer, the term of this patent is extended or adjusted under 35 U.S.C. 154(b) by 100 days.

(21) Appl. No.: 15/748,967

(22) PCT Filed: Jul. 7, 2016

(86) PCT No.: PCT/EP2016/067904
§ 371 (c)(1),
(2) Date: Jan. 30, 2018

(87) PCT Pub. No.: WO2017/017138
PCT Pub. Date: Feb. 2, 2017

(65) Prior Publication Data

US 2019/0003088 A1 Jan. 3, 2019

(30) Foreign Application Priority Data

Jul. 30, 2015 (EP) ..... 15179084

(51) Int. Cl.
*D04B 35/04* (2006.01)
*D04B 35/02* (2006.01)
*D04B 15/06* (2006.01)

(52) U.S. Cl.
CPC ..... *D04B 35/04* (2013.01); *D04B 15/06* (2013.01); *D04B 35/02* (2013.01)

(58) Field of Classification Search
CPC ..... D04B 15/06; D04B 35/02; D04B 35/04
(Continued)

(56) References Cited

U.S. PATENT DOCUMENTS 3,115,760 A 12/1963 Pierce
3,837,184 A * 9/1974 Meyerhuber ..... D04B 1/02 66/93

(Continued)

FOREIGN PATENT DOCUMENTS

CN 2400465 Y 10/2000
CN 101451289 A 6/2009

(Continued)

OTHER PUBLICATIONS

Office Action dated Feb. 2, 2019, in corresponding Chinese Patent Application No. 201680044778.X with English translation (24 pgs.).

(Continued)

*Primary Examiner* — Khoa D Huynh
*Assistant Examiner* — Grace Huang
(74) *Attorney, Agent, or Firm* — Fitch, Even, Tabin & Flannery LLP

(57) ABSTRACT

A loop-forming process includes moving a plurality of system components (11, 12) relatively to a needle bed (14). The system components (11, 12) contact threads (23) for forming loops. At least one spacer (10) is placed between at least two adjacent system components (11, 12) of the plurality of system components (11, 12) and defines the distance (21) between the two adjacent system components (11, 12), the spacer (10) being in mechanical contact to the two adjacent system components (11,12). The spacer (10) is placed away from and does not contact threads (23) and is moved with respect to the needle bed (14). The spacer (10) is also moved with respect to both of the two adjacent (Continued)

system components (11, 12) at least for a period of time during the loop forming process. An equivalent device is also disclosed and claimed.

18 Claims, 15 Drawing Sheets

(58) Field of Classification Search
USPC ..... 66/104, 105, 106, 107, 108 R, 108 A, 66/109, 110
See application file for complete search history.

(56) References Cited

U.S. PATENT DOCUMENTS

| | | | | |
|---|---|---|---|---|
| 4,137,730 | A | 2/1979 | Bassist | |
| 4,542,632 | A | 9/1985 | Reilly | |
| 4,574,596 | A * | 3/1986 | Engelfried | D04B 15/32 66/104 |
| 4,584,851 | A | 4/1986 | Plath | |
| 4,862,709 | A * | 9/1989 | Engelfried | D04B 9/02 66/104 |
| 5,475,991 | A * | 12/1995 | Yabuta | D04B 15/06 66/106 |
| 5,636,532 | A | 6/1997 | Shima et al. | |
| 6,014,874 | A * | 1/2000 | Shima | D04B 15/06 66/106 |
| 6,122,938 | A | 9/2000 | Henning et al. | |
| 6,568,222 | B1 * | 5/2003 | Morita | D04B 15/06 66/106 |
| 6,978,642 | B2 * | 12/2005 | Morita | D04B 15/06 66/109 |
| 7,673,478 | B2 | 3/2010 | Krauss et al. | |
| 10,513,807 | B2 * | 12/2019 | Fukui | D04B 9/12 |
| 2010/0175428 | A1 | 7/2010 | Lonati et al. | |
| 2013/0067963 | A1 * | 3/2013 | Lin | D04B 15/36 66/78 |
| 2019/0003090 | A1 * | 1/2019 | Wornle | D04B 35/02 |

FOREIGN PATENT DOCUMENTS

| | | | |
|---|---|---|---|
| CN | 102182002 | A | 9/2011 |
| CN | 102947498 | A | 2/2013 |
| DE | 610511 | C | 3/1935 |
| DE | 3311361 | A1 | 10/1984 |
| DE | 19740985 | A1 | 4/1999 |
| DE | 69803142 | T2 | 8/2002 |
| DE | 102013104189 | A1 | 11/2013 |
| EP | 0672770 | A1 | 9/1995 |
| EP | 1860219 | A1 | 11/2007 |
| EP | 2578733 | A1 | 4/2013 |
| GB | 2205588 | A | 12/1988 |
| JP | 55-051855 | A | 4/1980 |
| JP | 01-052855 | A | 2/1989 |
| JP | 64-52855 | A | 2/1989 |
| JP | 2012012757 | A | 1/2012 |
| JP | 2013237936 | A | 11/2013 |
| TW | 200912064 | A | 3/2009 |
| WO | 2011/152361 | A1 | 12/2011 |
| WO | 2012055591 | A1 | 5/2012 |
| WO | 2013041380 | A1 | 3/2013 |

OTHER PUBLICATIONS

International Search Report and Written Opinion in corresponding International Application No. PCT/EP2016/067904, dated Sep. 14, 2016, 11 pages.
Extended European Search Report in corresponding European Application No. EP15179084.7, dated Oct. 29, 2015, 6 pages.
Office Action in corresponding Bangladeshi Application No. 181/2016/1845, dated Jun. 12, 2017, 1 page.
Chinese Second Office Action dated Oct. 8, 2019 and Search Report dated Sep. 23, 2019, in corresponding Chinese Patent Application No. 201680044778.X, with English translation (9 pgs.).
Vietnamese Office Action dated Aug. 31, 2020, in corresponding Vietnamese Application No. 1-2018-00801, with English translation (4 pages).
Indian Office Action dated Sep. 18, 2020, in corresponding Indian Applicaiton No. 201737046459 (7 pages).
Japanese Notice of Reasons for Refusal dated Aug. 26, 2020, in corresponding Japanese Application No. 2018-524546, with English translation (8 pages).

* cited by examiner

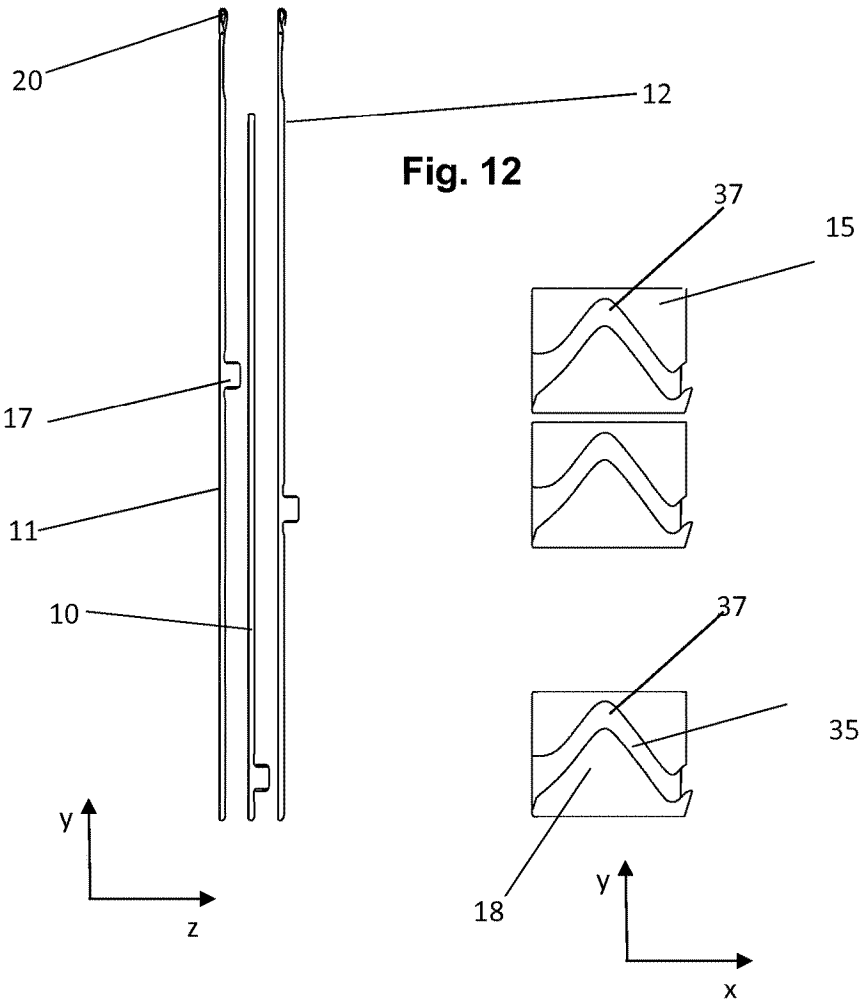
Fig. 11
Fig. 12
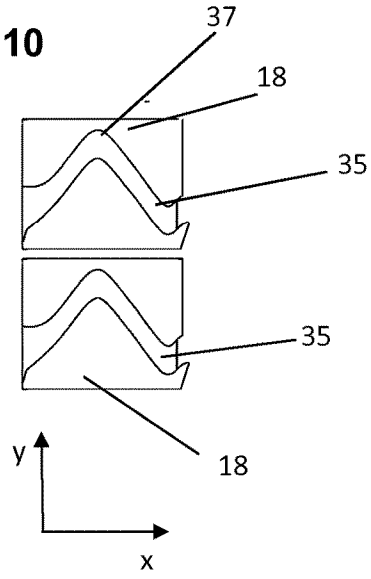
Fig. 10
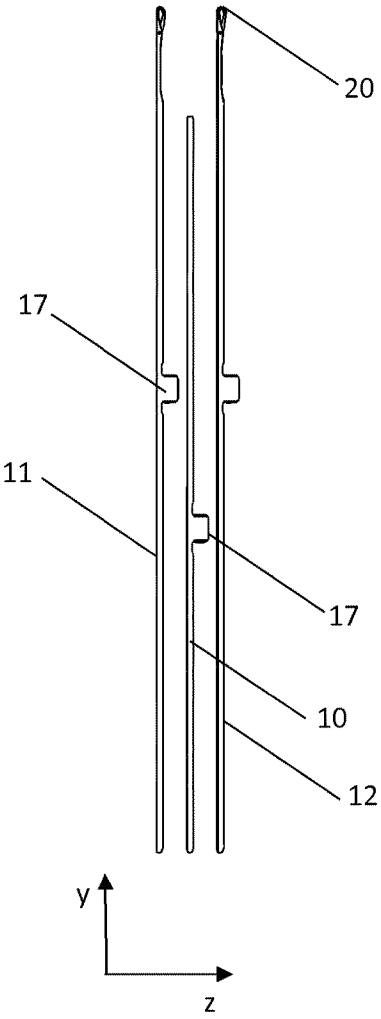
Fig. 9

LOOP-FORMING METHOD AND DEVICE

CROSS REFERENCE TO RELATED APPLICATIONS

This patent application is the national phase of PCT/EP2016/067904 filed Jul. 27, 2016, which claims the benefit of European Patent Application No. 15179084.7 filed Jul. 30, 2015.

TECHNICAL FIELD

Various types of knitting machines are well known. Circular knitting machines, flat knitting machines or warp knitting machines belong to the most important types of these machines.

BACKGROUND

Knitting machines usually comprise at least one needle bed for supporting knitting tools. Needle beds of circular knitting machines are often called "cylinder". This phrase takes their cylindrical shape into account. In the present publication the impression "needle bed" refers to all kinds of devices that support knitting tools no matter if they are flat, cylindrical or whatever.

Knitting tools are for example needles, sinkers or the like. Knitting tools are parts of knitting machines that are directly involved in the loop forming process and hereby have contact to threads. The different knitting tools grasp, lead or hold down the threads. In the present publication all knitting tools are called "system components".

One kind of special system components are slider needles. The publication DE 698 03 142 T2 shows a slider needle. The respective slider's profile is u-shaped in the plane perpendicular to the slider's movement. As a result the legs of the u-shaped sliders partially embrace the shank of the needle on which the respective slider is moved. One could also say that any leg is partially arranged between the needle shank of the needle on which the respective slider is moved and the adjacent needle or the adjacent needle shank. During the knitting process there are relative movements between the needle shank and the slider. Hereby the slider temporarily closes the opening for the thread inside the hook or carries the thread along the needle shank. In doing so the slider gets regularly in contact with the thread.

During knitting the various types of system components acting in different types of knitting machines have relative movements to at least one kind of needle bed. These relative movements in channels of the needle bed generate some problems which are inherent in most modern knitting machines:

High frictional load between system components and needle bed or even sticking of the system components in the channels. The friction causes wear on system components and needle bed and generates undesirable heat in the knitting machine.

In publication DE 10 2013 104 189 A1 the problem of sticking of sinkers in the channels caused by the not longitudinal components of the actuation of the sinkers' butt is discussed. This publication proposes to use two sinkers of different length in one common groove to solve that problem.

The publication EP 0 672 770 A1 shows a flat knitting machine for knitting a tubular knitted fabric. One of the shown knitting machines uses two needles in one common groove. The needles are provided with transfer elements as blades. The said publication mentions that a spacer can be necessary to prevent interference between the needles caused by the transfer elements. The spacer itself and its mode of operation are not described in more detail.

The publication DE 33 11 361 A1 shows a knitting machine comprising needles and sinkers for loop-forming that move in the same longitudinal direction. Said knitting machine comprises a first cylinder placed in a lower region of the knitting machine where the needles are supported in channels. The needles used have a very long shank so that the hook is always far outside the needle cylinder in an upward direction. On top of the needle cylinder there is an additional cylinder for supporting the sinkers and the sinkers are short compared to the needles. The aforementioned long shanks of the needles are on top of the trick walls of the channels of the cylinder for the sinkers and therefore between the sinkers. The means for loop-forming of the needles and the sinkers (hook, holding-down-edge and knock-over-edge) extend in a region of the knitting machine where loops are formed. Said region is located upside of the cylinder of the sinkers. The needles and the sinkers are hereby at least partially separately guided in channels and thus the friction is reduced compared to an arrangement where needles and sinkers are solely guided in common channels.

The application DE 197 40 985 A1 shows recesses on the flat sides of knitting needles or on the walls of channels of a needle bed. The recesses are only provided in certain regions of the side faces of the knitting needles and not on the full length of the side faces of the needles. As a result of these measures, the surface area of the contacting surfaces of the said elements of the knitting process is reduced. Thus the energy consumption and the heat generation in the machine are reduced.

The application EP1860219A1 shows knitting needles with a relatively thin shank. Some of the figures of this publication show in a cross-sectional view that the needles are arranged askew or diagonally in the needle grooves so that only a top corner and the opposing bottom corner of the needles' cross section touch the needle groove. The surface area of the contacting surfaces is once again reduced so that the energy consumption of the system decreases. The heat generation is thus also reduced.

The application WO2012055591A1 shows a knitting machine which was constructed for the following purposes: High gauge, low manufacturing costs and low energy consumption. The publication proposes to provide two needles per needle channel.

Application WO2013041380A1 shows a knitting machine with improved actuation cams for side by side needles as shown by the aforementioned WO2012055591A1. The knitting machines can be produced at lower costs and high quality fabrics can be produced.

The DE610511B discloses two very similar types of needles. Both types comprise a thick (in the direction of the width of the needles) and stable rear part which carries the needle butts. The difference between the two needle types is that the first group is provided with a longer rear part than the other type.

The front parts of both types of needles, which support the hook, are relatively thin. The front parts have the same length.

In the needle beds shown by this publication a segment of the thin front part of each of the needles is guided in a respective slot of the needle bed. Needles of the long type surround groups of needles of the short type. An end segment of the rear part of the long needles is additionally guided by respective slots. The side faces of segments of the thicker rear parts of adjacent needles are in contact with each other. The DE610511B aims at reducing the costs for grinding the common long needle channels of the needle beds of most knitting machines: These long channels are replaced by the above mentioned slots which only cover relatively small segments of the length of the needles. However, this publication fails to teach a knitting device which is apt to the requirements of modern knitting processes: If the knitting beds shown in the DE610511B were subject to modern knitting velocities the needles would be bent. Therefore the needles would become subject to undue wear or the needles would even stick in the respective slot.

SUMMARY

It is the object of the present invention to provide a process and a device which use an easier to manufacture needle bed which is also fit for modern loop forming velocities.

The inventive loop forming process uses at least one movable spacer between the system components which are equipped with loop forming means and which are moved in the channels of the needle bed. The aforementioned use of the spacer allows the use of needle beds with very broad channels or grooves which can be equipped with a plurality of system components and at least one spacer. Very advantageous needle beds are equipped with channels which have a width which is equal to or more than 0.8, 0,9, 1, 1.2, 1.3, 1.5, 2 or 3 times the pitch of the respective needle bed. Most spacers are easy—and therefore cost effective—to produce.

In accordance with the inventive loop-forming process the system components are moved relatively to a needle bed. The direction of the movement of the system components with respect to the needle bed is the longitudinal direction defined by the longitudinal extension of the channels or grooves of the needle bed. The system components are inserted and moved in these channels. In an end region of the needle bed the loops are formed. As already mentioned the system components are provided with special means for loop forming such as hooks and latches. These means of the system components are moved in said end region of the needle bed (loop-forming zone). In said end region of the needle bed the hooks and latches of the needles have contact to the threads and form loops with said threads. Usually the spacers are placed away from the threads and do not contact them.

In accordance with the inventive loop-forming process at least one spacer is inserted in at least one channel of the needle bed. Preferably there is one spacer between two system components. It is also possible that there is more than one spacer between two system components or that there are also spacers between the system components and the walls of the channels of the needle bed.

The spacers define the distance between two adjacent system components. In a preferred embodiment the width of the spacers in a direction x, which is the direction of the width of the channels of the needle bed, is the same as the width of the walls which delimit the channels of the needle bed. Preferably, both side surfaces of the spacers, that are perpendicular to the direction x, are in mechanical contact to one of the side surfaces of each of the two adjacent system components.

The spacers can be shorter in the longitudinal direction than the system components. It is however advantageous if at least parts of the spacer extend in segments of the longitudinal extension y of the grooves in which the system components are provided with butts. The spacers have no means such as hooks or latches that are intended for contacting threads. The shape of the spacers allows them to define the distance of the system components even in the end region of the needle bed. The spacers do not get in contact with the threads.

The movement of the at least one spacer has the same longitudinal direction as the direction of the movement of the system components. In most cases, the spacer or even a plurality of spacers is put in one groove with a number of system components. It is also advantageous to place at least one spacer between a wall and a system component. The spacers are moved with respect to the needle bed (first relative velocity). One could also say that the at least one spacer of the present invention replaces a wall which delimits two grooves of a state-of-the-art needle bed of a knitting machine. The relative velocity between the spacer and the two adjacent system components can be much lower than the relative velocity between the wall of the state-of-the-art needle bed and the system components in the two grooves. Therefore, the friction between the system components and the spacer is lower than the friction between the system components and the aforementioned wall of the state-of-the-art needle bed.

This fact might be the source of another important property of the present invention: inventive embodiments and processes can save energy.

Most system components comprise two opposing flat side surfaces which can at least partially come in contact with walls of channels of the needle bed in which they are inserted for knitting. Additionally, parts of smaller surfaces can get in contact with the bottom of the channel. At least the first mentioned kind of friction can be reduced by the movable spacers.

A relative movement of the at least one spacer with regard to the two adjacent system components is advantageous. Most of the time, the movements of the spacer and the two adjacent system components comprise periodic movements between minima and maxima in the longitudinal direction of the needle channels. The phrase "there is a relative movement of the at least one spacer with regard to the two adjacent system components" does not exclude that there could also be periods of time during such a period of the movements in which these elements (the spacer and the two adjacent system components) rest with regard to each other.

It is advantageous, if the periodic movements of the spacer and one or both of the adjacent system components relative to the needle bed have the same direction at least during half of the period of the movement of the spacer. Longer periods of time in which the movements have the same direction are even more advantageous (more than 70, 80 or 90%).

Other tests (other needle types, other oil, other velocities, other gauges) have shown that it can be sufficient if the period of time in which the system components and the spacers are driven in the same direction is longer than the period of time in which these elements have opposed directions. The latter condition is different from the first condition since there are also periods of time in which the elements are nearly at a standstill with respect to each other.

If the relative movements of the aforementioned elements with regard to the needle bed is positive (more than nil) and have the same direction, the relative velocity between the spacer and the two adjacent system components is lower than the relative velocity of each of the aforementioned elements with regard to the needle bed. This fact seems to be important for the overall reduction of the energy consumption during the loop forming process. Therefore, more advanced inventive loop forming processes are characterized by very long periods of time in which the aforementioned condition is met.

In most knitting machines longitudinal relative movements between system components and the needle bed are initiated by relative movements of the needle bed to cams. These relative movements are in the direction x of the width of the channels and thus perpendicular to the longitudinal relative movements in the direction y. Thus the interaction of system components with the cams initiates the longitudinal movement needed for forming loops. However, this kind of interaction also delivers force in a perpendicular direction to the system components which pushes them against the walls of the channels and is therefore a source of undesired friction. As said before the force which moves the system components and spacers in their respective grooves can be provided by the relative movements of the spacers' and system components' butts along cam tracks which are defined by cams which are fixed on cam holders. Circular knitting machines are usually provided with cam holders which are fixed on the machine frame. Flat knitting machines often use cam holders which are part of carriages which are moved with regard to the needle bed. In both cases there is a relative movement between cam holders and needle beds.

The elements which are driven by the aforementioned relative movement between cam holders and needle beds could be provided with at least one butt.

The movements performed by the at least one spacer and the two adjacent system components relative to the needle bed could be equal (the same velocity and/or magnitude of movement etc.). The respective movements could however have a certain delay of time (a certain phase shift).

Such movements by spacers and system components can be initiated by the same at least one cam (even all cams necessary for the movements inside one system can be the same). In the latter case all aforementioned elements would follow the same cam track (all movements are the same but have a delay).

It is also advantageous, if at least one of the two adjacent system components provides the spacer with the force for its movements. Usually such a spacer doesn't need a butt for interacting with cams. The transfer of the respective force from the at least one system component to the spacer can for example be provided by the friction between these elements.

As already mentioned above the spacers are preferably devoid of loop forming means whereas the system components are provided with such means. Even more preferably, the spacers do not control the movement of such system components directly or indirectly via another element. This means that the spacers, according to the present publication do not preferably serve as controlling element or controlling sinker (for example for knocking over sinkers or the like). It is also advantageous if the spacers also do not serve as a means for selecting needles or system components during the knitting process (selection element, selection sinkers). It is therefore also preferred if the spacers are devoid of recesses, protrusions, juts or the like which guide a—or establish mechanical contact with a—system component or with a further member, which controls a system component.

The distance between the two adjacent system components is only or exclusively defined by one or by a plurality of spacers. If there is a plurality of spacers which defines the distance between the two adjacent system components, at least two spacers could have contact with one of those system components.

An adjacent system component is a system component which is nearest to the other adjacent system component in one direction in the same needle bed.

Further characteristics and advantages of the invention will become better apparent from the description of the figures. The figures show preferred but not exclusive embodiments of the invention and therefore provide non limiting examples. Most of the individual features shown can be used with advantages for improving the present invention in its broadest form.

BRIEF DESCRIPTION OF THE DRAWINGS

FIG. 9 shows sketches of a first group of elements FIG. 10 shows sketches of a first group of cams consisting of two cams FIG. 11 shows sketches of a second group of elements FIG. 12 shows sketches of a second group of cams consisting of three cams

DETAILED DESCRIPTION

Figure 1:
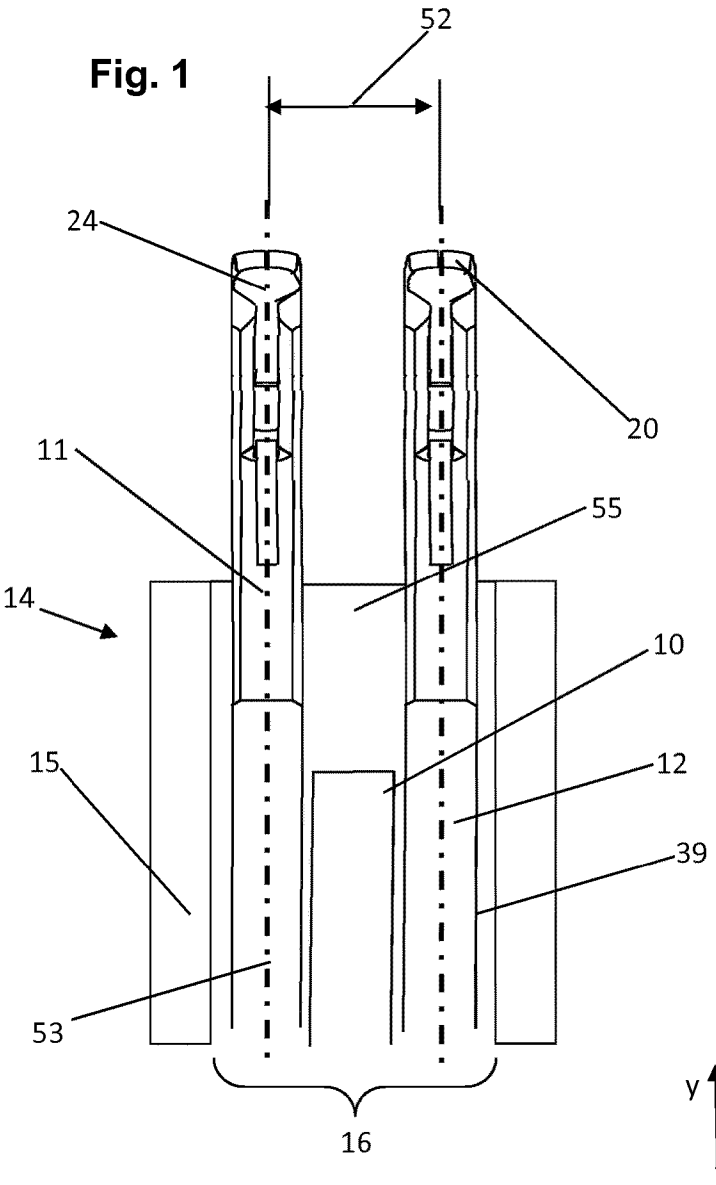
FIG. 1 provides a plain view of a first groove equipped with system elements FIG. 2 provides a plain view of a second groove equipped with system elements FIG. 3 provides a plain view of a third groove equipped with system elements

FIG. 1 provides a plain view of the first groove 16 of the needle bed 14 which is equipped with system components 11, 12. Each of the system components 11, 12 is provided with a hook 20 and a latch 24. The hooks and the latches are also jointly denoted as loop forming means 20, 24. Between the two adjacent system components 11, 12 there is a spacer 10. The spacer 10 has no mechanically stable connection with any of the two system components 11, 12.

The line 53 is a symmetry line which is directed in the longitudinal direction y parallel to the side surfaces of the needles' or system components' 11, 12 shanks 39 and which crosses the centre of the needles' hook 20. The distance between the two symmetry lines 53 shown in FIG. 1 is called pitch 52. This distance is well known to the man skilled in the art since it denotes the properties of the knitted fabric which can be produced by a needle bed 14 which comprises a groove 16 like the one shown in FIG. 1. The pitch is measured in millimetres and simply denotes the aforementioned distance. Another even more current way to denote the properties of the needle bed 14 and the fabric, which can be produced on it, is the gauge which denotes the number of needles 11, 12 per inch which can be included in one needle bed 14. FIG. 1 also shows that the system component 11 is symmetrical with regard to the symmetry line 53. The three aforementioned elements spacer 10, system component 11 and system component 12 are placed in a groove 16 which is delimited by the immovable walls 15 and the bottom 55 of the groove 16.

Figure 2:
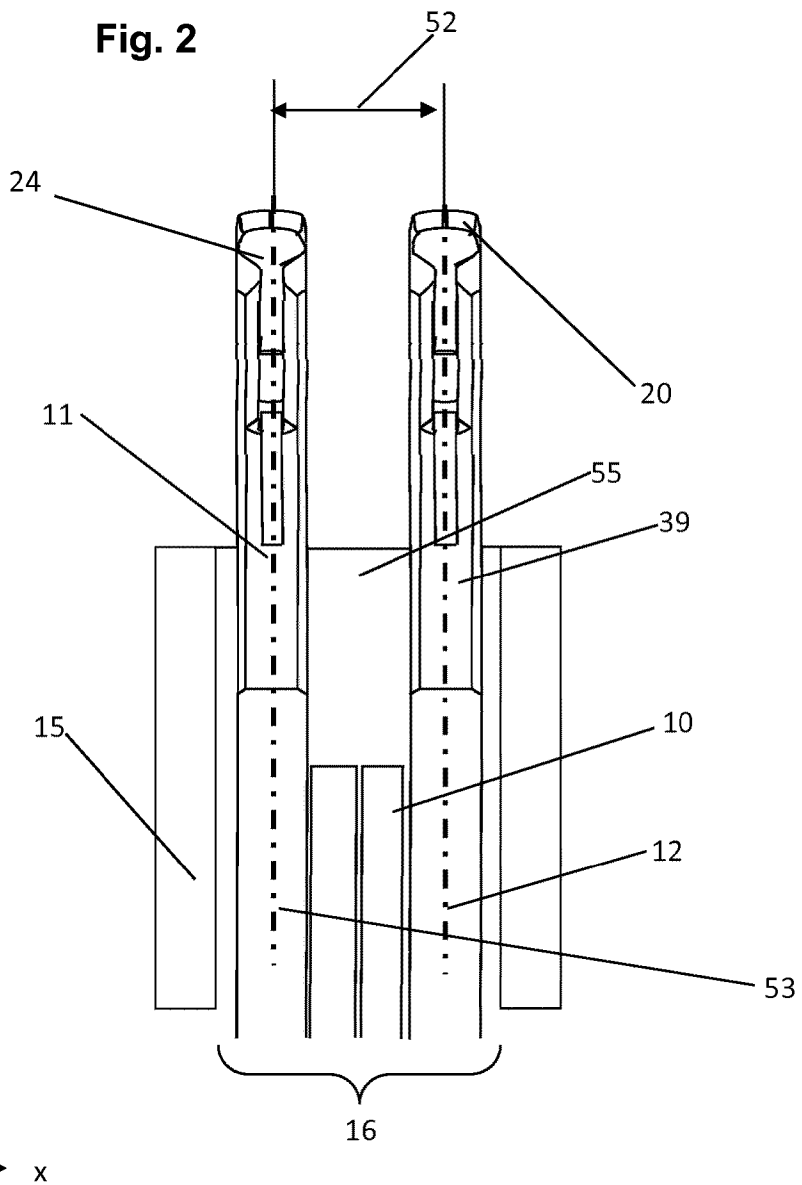

FIG. 2 shows a slightly different groove 16 which is equipped with two system components 11, 12 and two spacers 10 which provide for the distance between the loop-forming means 20, 24 of the two adjacent system components 11, 12. The respective spacers 10 are once again not immovably connected with the system components 11, 12 so that these elements 10, 11, 12 can move individually in the groove 16. The system components 11, 12 are symmetrical with regard to the symmetry line 53. The system components 11, 12 can be standard needles which are symmetrical with regard to the dotted line 53 which cuts the respective system components in two halves.

Figure 3:
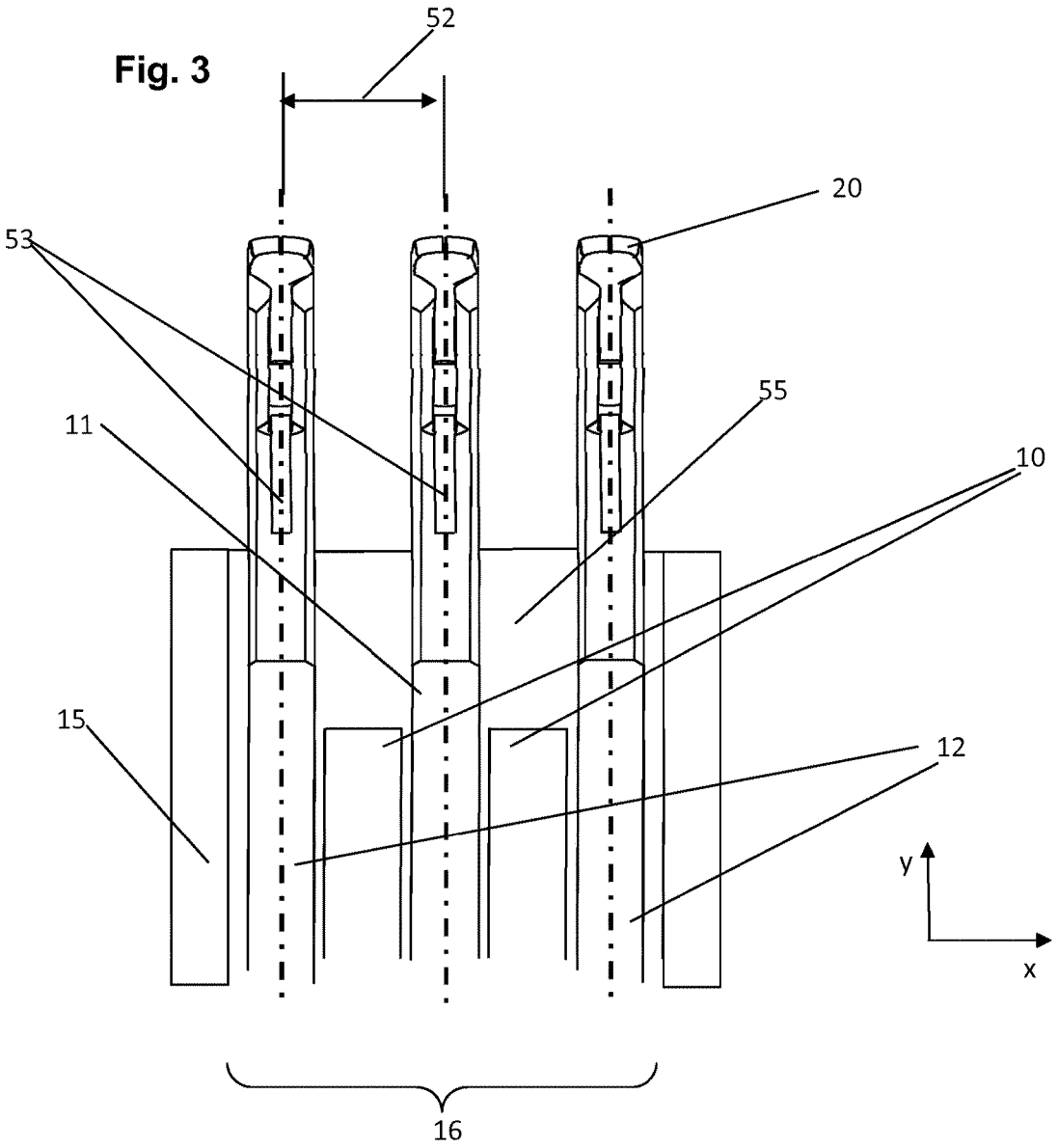

FIG. 3 shows an embodiment of a further groove 16 which is delimited by the immovable walls 15 and the bottom of the groove 55. There are three system components movably placed in the grooves 16. The distance between their loop forming means 20, 24 is adjusted by the two spacers 10.

FIGS. 1, 2 and 3 elucidate a very beneficial property of the invention: the grooves 16 are broader (possess a bigger width in the direction x) than state-of-the-art needle beds 14 with the same pitch as the inventive ones. Needle beds which are appropriate for the present invention have a width which is 0.7 times bigger than the pitch 52, or even bigger than the pitch 52 or even bigger than 1½ times the pitch 52. The grooves which are provided with the aforementioned pitch can have a length which equals at least 95, 90, 85, 80, 70 or 60% of the system components' length. The respective grooves 16 are easy to manufacture: according to the state-of-the-art such grooves or channels are either grinded or the immovable walls 15 are fixed in or on the bottom 55. In both cases the manufacturer can save a lot of money if he can confine himself to manufacturing a smaller number of broader grooves. Moreover, such broad grooves are easy to clean and the oil consumption of the overall new device is smaller than in most state-of-the-art devices. The respective grooves can have a length which is preferably bigger than 150, 120, 95, 90, 85, 80, 70 or 60% of the system components' length. A needle bed can be equipped with 1, 2, 3 or exclusively or nearly exclusively with grooves of this kind.

Figure 4:
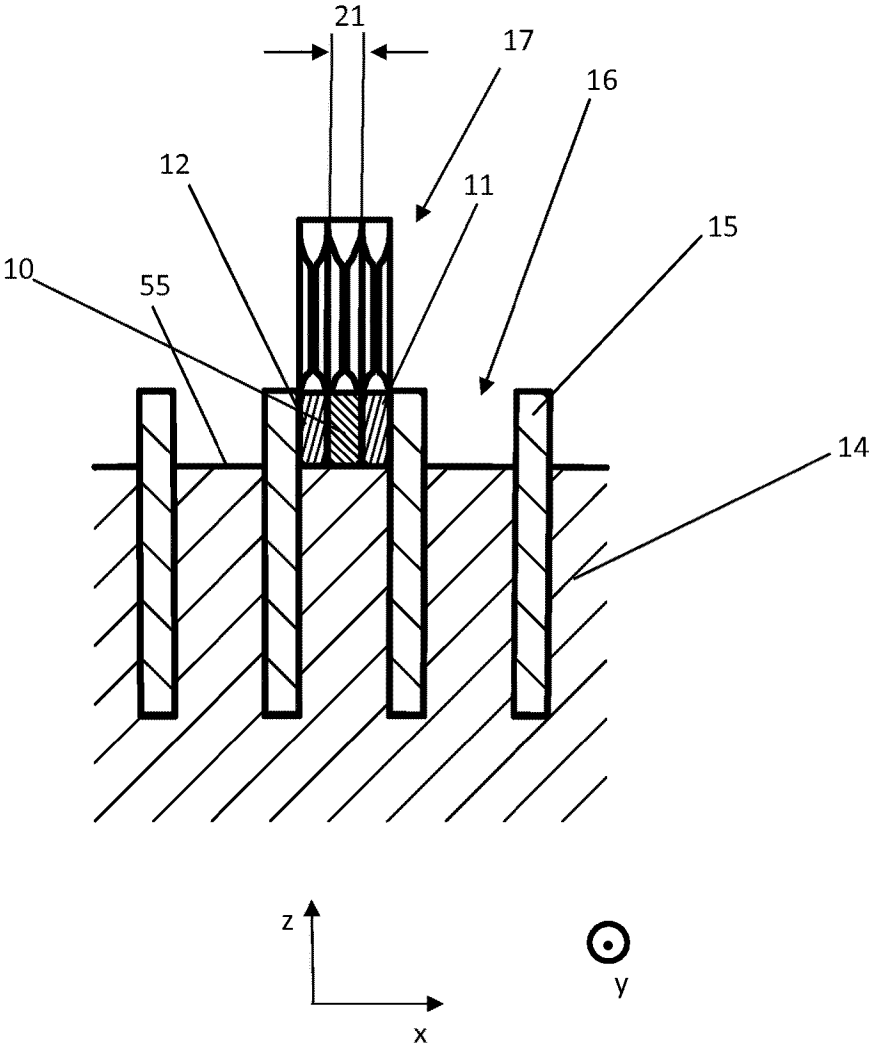
FIG. 4 shows a cross section of a first needle bed

FIG. 4 shows a cross section of a first needle bed 14. The needle bed 14 comprises grooves/channels 16 which are delimited against each other by the immovable walls 15. One of the grooves 16 is provided with a first needle 11 and a second needle 12. There is a spacer 10 between the needles 11 and 12. The spacer 10 defines the distance 21 between the needles 11 and 12. Usually this distance mainly or completely extends in the direction x. All elements 10, 11, 12 are provided with butts 17 which receive the force for the movement of the respective element.

The embodiment shown in FIG. 4 is provided with immovable walls 15 which have the same width (in direction x) as the shank of the spacers 10. This measure is also advantageous for all inventive embodiments. The shanks of the system components can also have the same width (x-direction). There are other embodiments of the invention with different widths of shanks and immovable walls.

Figure 5:
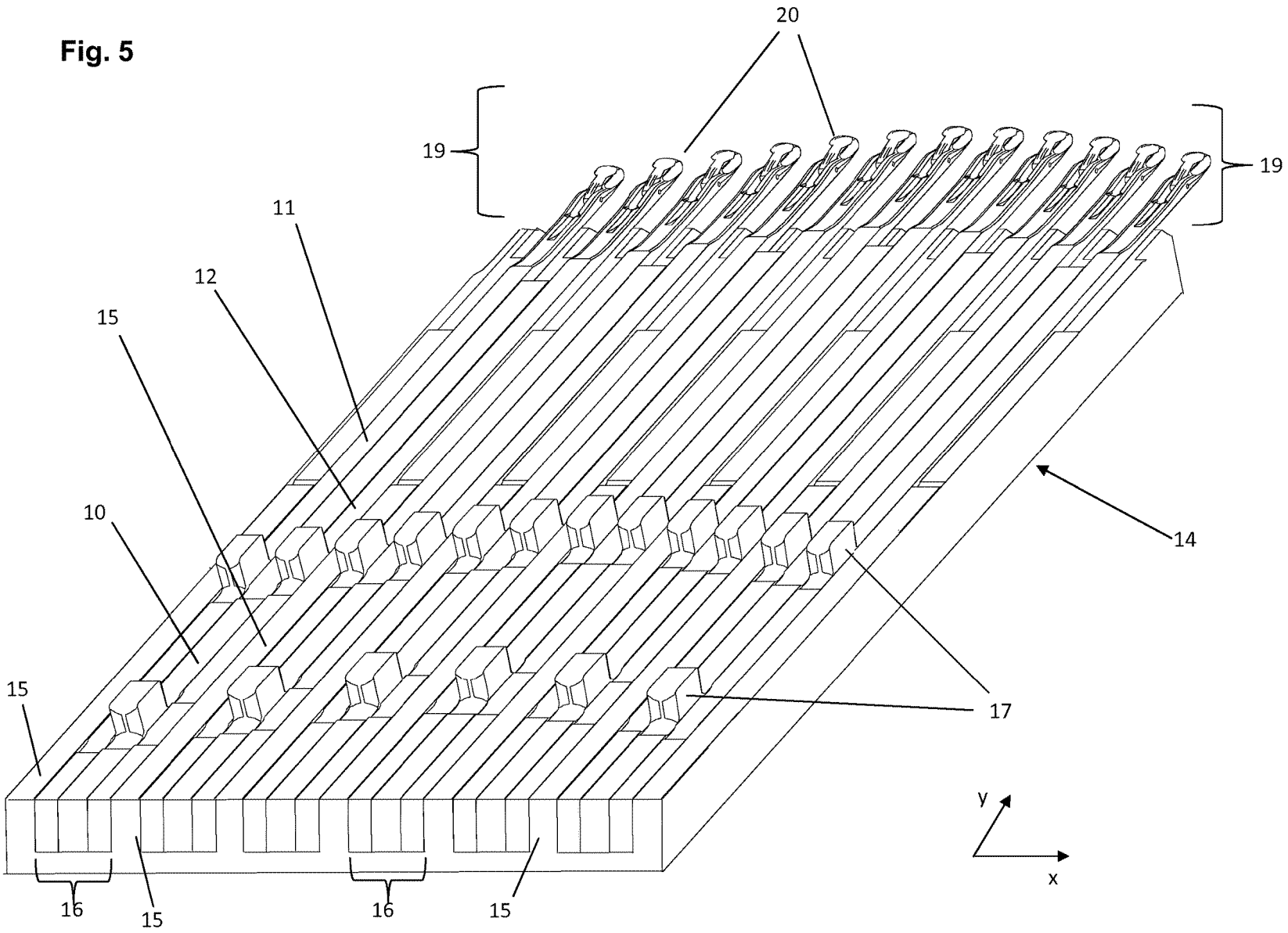
FIG. 5 is a section of a perspective view of a second needle bed

FIG. 5 is a section of a perspective view of a second needle bed 14. The needle bed 14 is provided with grooves 16. Their width is symbolized by the brackets 16. The grooves 16 are delimited against each other by immovable walls 15. Each groove 16 comprises a spacer 10 and a first needle 11 and a second needle 12. Each of these elements 10, 11, 12 is provided with a butt 17. The needles have hooks 20 at their front end, which extend in the loop-forming zone 19. The loop forming zone 19 is the zone or area in which the loops 33 are formed. The spacers 10 do not extend in the loop-forming zone 19 and the spacers 10 are not provided with hooks 20 or any other kind of loop-forming means.

In the embodiment shown by FIG. 5 the butts 17 of the spacers 10 are provided at another longitudinal position y than the butts 17 of the needles 11, 12. This means that the spacers' butts 17 use other cams 18 than the needles' butts 17.

As already mentioned above the spacers 10 and system components 11, 12 can also use the same cams 18—or in summary—the same cam track as the spacers 10. In this case the butts of the aforementioned elements 10, 11, 12 can be provided at a corresponding longitudinal position on the different elements' longitudinal extension.

FIG. 5 also shows, that spacers 10 and needles 11, 12 perform an at least very similar movement in their longitudinal direction y (see position of the butts 17 of spacers 10 and system components 11, 12 which form a very similar "curve"). The fact that the FIGS. 4 and 5 only show needle beds 14 with grooves 16 which are provided with three elements 10, 11, 12 does not mean that there are not a lot of other advantageous possibilities: Two spacers, and three system components 11, 12, three spacers and two system components etc.

Moreover, the readers are reminded that the term "system components" is not limited to needles but also comprises sinkers and other devices which get in contact with the thread 23 and take part in the loop forming process.

Figure 6:
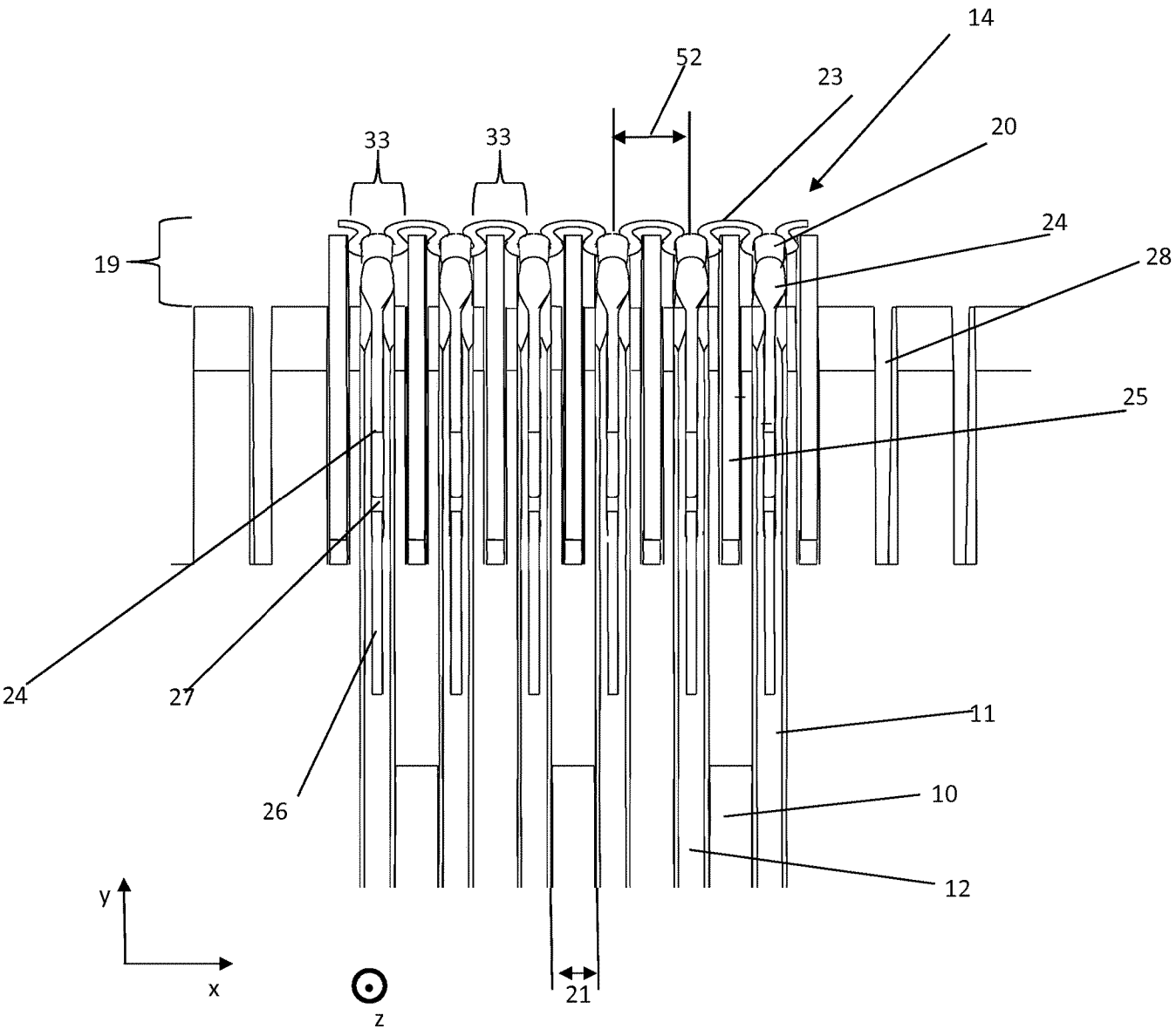
FIG. 6 is a top view of the section of a third needle bed

FIG. 6 shows a top view of a third needle bed 14. Needle beds of the kind shown in FIG. 6 are often used in circular knitting machines. In the case of circular knitting machines the needle bed 14 would also be called needle cylinder. FIG. 6 shows an example of a loop-forming process which takes place in the loop-forming zone 19. The needles 11, 12 and especially the hooks 20 and latches 24 take part in the loop forming process and therefore get in contact with the yarn 23. The sinkers 25 also get in contact with the yarn 23. The extension of the loops 33 in x-direction is symbolized by the brackets 33. FIG. 6 also shows some more details of the needles 11, 12 and the needle bed 14 which are well known to the man skilled in-the-art: The latches 24 are pivoted in the saw slot 26. During the loop forming process the latches 24 swing around the pivot 27 so that the interior of the hooks 20 is opened and closed for the yarn 23 by the latches 24. During the loop forming process the needles essentially move in the direction y of their shanks or of the grooves 16 of the needle bed 14. The sinkers 25 essentially move in the direction z of the height of the shanks of the needles 11, 12. The needle bed 14 is provided with slots 28, which look like teeth in the view provided by FIG. 6. The slots 28 guide the sinkers' 25 movements. The differences between the sinkers 25 and the spacers 10 can be summarized as follows.

The spacers 10 essentially move in the same direction as the system components 11, 12. The spacers are also devoid of loop forming means like hooks 20 and latches 24 and the like and do not take part in the loop-forming process. Moreover, the spacers essentially define the distance between two neighboring or adjacent system components 11, 12. Most of the time the sinkers 25 and the respective system components 11, 12 still have a certain distance, so that the distance between these system components 11, 12 is the sum of these distances and the sinkers' 25 width. These aforementioned distances in the loop forming area are necessary to provide the yarn with enough space for the loop forming process and to avoid too much friction between the different elements.

FIG. 6 also provides a different possibility to define the distance between adjacent loop-forming means. The numeral 52 (see pointer 52) denotes the distance between the centers of the hooks 20 of two adjacent system components. This distance 52 is (of cause) equal to the distance of two adjacent loops 33 which are being formed by the respective hooks. The man-skilled-in-the-art often calls this distance "pitch" (the pitch denotes this distance in millimetres whereas the gauge is the number of needles per inch). In most loop-forming methods and also in most loop-forming devices this pitch is even (all system components of one needle bed have the same distance with regard to each other). Otherwise the knitted fabric produced by such a machine would be perceived as uneven by the consumer. With regard to the present invention one could also say that the spacer adjusts or helps to adjust the pitch between adjacent needles or system components.

Figure 7:
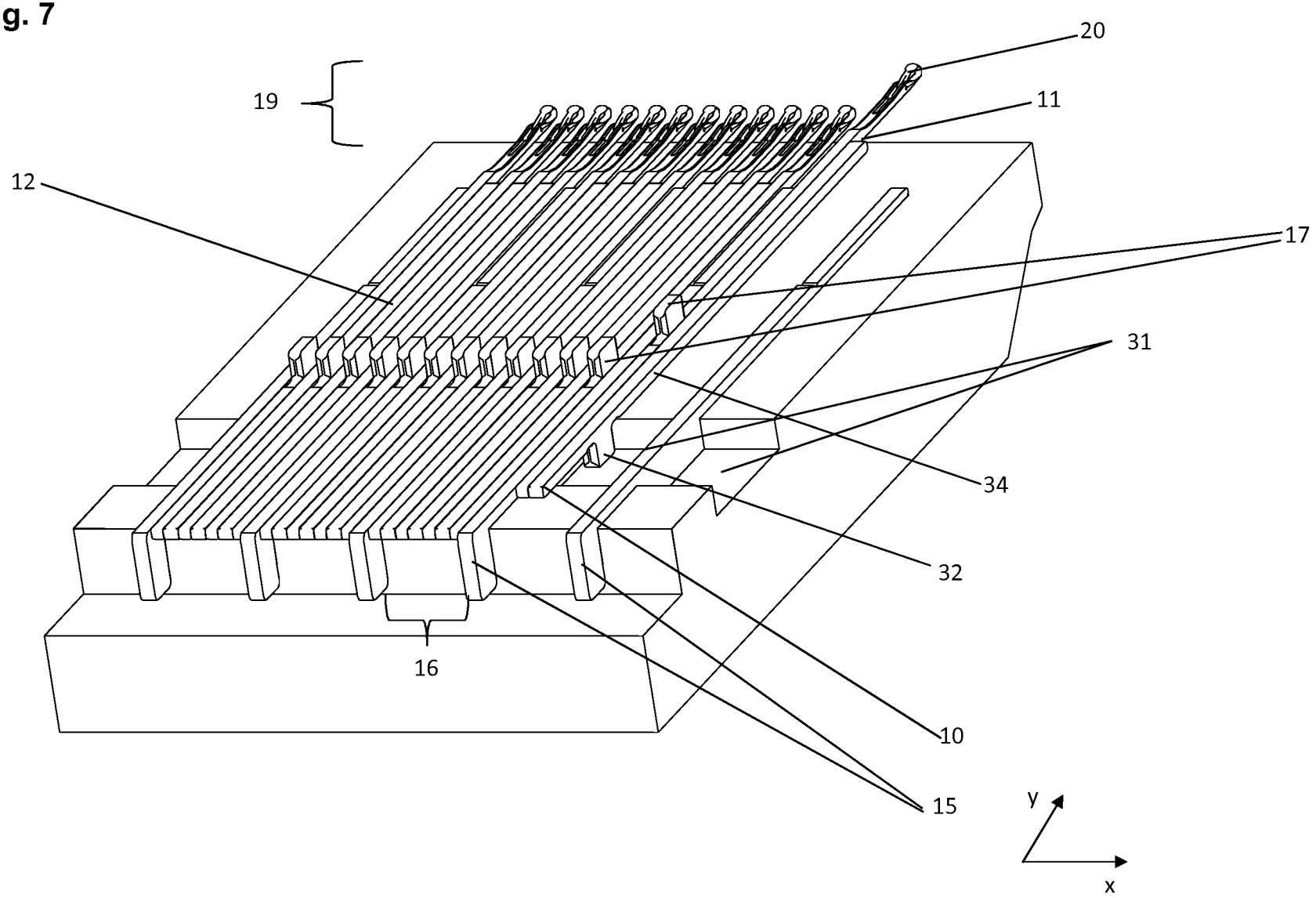
FIG. 7 is a section of a perspective view of a fourth needle bed

FIG. 7 shows the fourth example of a needle bed in a further perspective view which is very similar to the perspective view provided by FIG. 5. Therefore the description of FIG. 7 can be confined to the differences between the needle beds 14 shown in FIGS. 5 and 7: in FIG. 7 the grooves or channels 16 for guiding elements 10, 11, 12 are provided with three spacers 10 and four needles 11, 12 (which means that the width of the grooves 16 is bigger than three pitches which is very advantageous if applied to any embodiment of the present invention). Once again a spacer is placed between two needles 11, 12. The grooves 16 are also delimited by immovable walls 15 against each other. FIG. 7 additionally shows movement limitation recesses 31 which can limit the movement of the spacers 10. The respective spacers 10 are provided with movement limitation butts 32 which protrude in the recesses 31 and limit the movements of the spacers 10 in the direction y of the channels 16.

Figure 8:
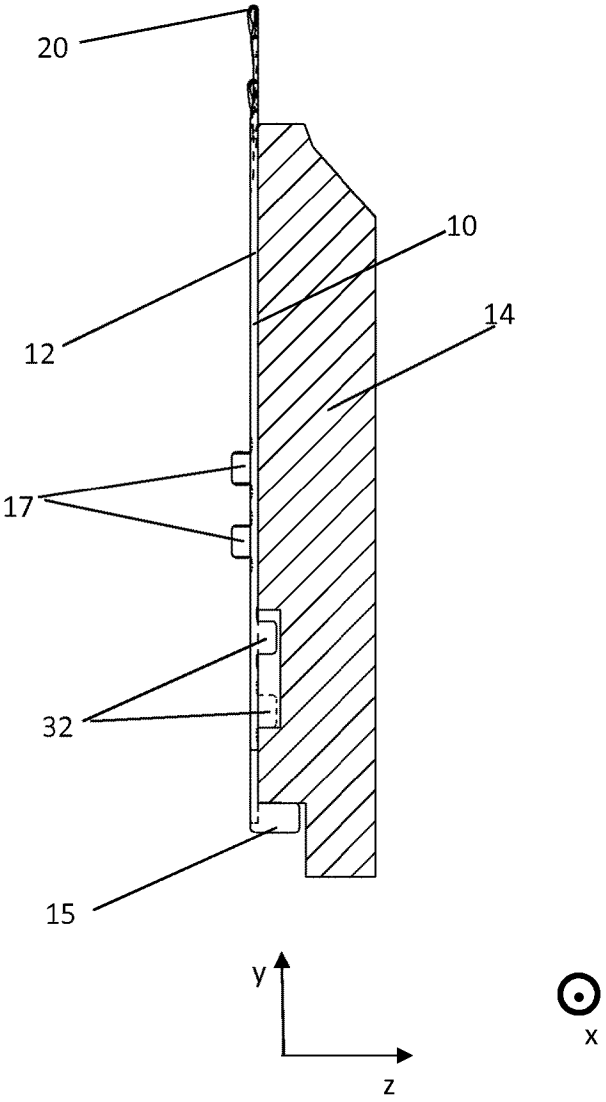
FIG. 8 is a cross-section of a fifth needle bed

FIG. 8 shows a cross-section of the same fourth embodiment of the needle bed 14. The provision of movement limitation means 31 and 32 is advantageous for all embodiments of the invention. It is especially advantageous for embodiments which are provided with spacers 10 which do not receive the force for their relative movement from cams. Another alternative source of this force is one or even a plurality of adjacent system components 11, 12. In this case it is possible not to provide cams 18 for the spacers' 10 movements. One possibility to transfer the force is friction between the elements 10, 11, 12.

As said before FIG. 8 is a cross-sectional view of the fourth embodiment. The fourth embodiment is shown in FIG. 8 along the plane of the right hand surface 34 of the spacer 10 shown on the right side of FIG. 7. FIG. 8 shows the spacer 10 and the adjacent needle 11 in two different positions in the direction y (see continuous and dotted line).

FIG. 9 shows a first needle 11 and a second needle 12 and a spacer 10 which is to be placed between them 11, 12. The needles or system components 11, 12 are provided with butts 17 at a different position in the direction y than the spacer 10. FIG. 10 shows the cams 18 which define a passage 35 for the butts 17 of the aforementioned elements 10, 11, 12. In this way the two cams 18 symbolize that the spacer 10 and the needles 11, 12 of FIG. 12 have different cam tracks. The FIGS. 11 and 12 provide a different example of this kind.

FIG. 11 shows a first needle 11, a spacer 10 and a second needle 12. Each of these elements has its respective butt 17 at a different longitudinal position y. Consequently, FIG. 12 shows three cams 18 at three different positions in y-direction respectively. In this way FIGS. 11 and 12 symbolize that the three aforementioned elements 10, 11, 12 have three different cam tracks.

The figures elucidate a foremost property of the invention. The grooves 16 are broader (possess a bigger width in the direction x) than state-of-the-art needle beds 14. Needle beds which are appropriate for the present invention have a width which is bigger than their pitch times 0.7, or even bigger than their pitch 52, or even bigger than their pitch 52 times 1½, 2 or 3. The grooves 16 which are provided with the aforementioned pitch can have a length which equals 95, 90, 85, 80, 70 or 60% of the system components' length. The respective grooves 16 are easy to clean and the oil consumption of the overall new device is smaller than in the case of most comparable state-of-the-art devices.

Figure 13:
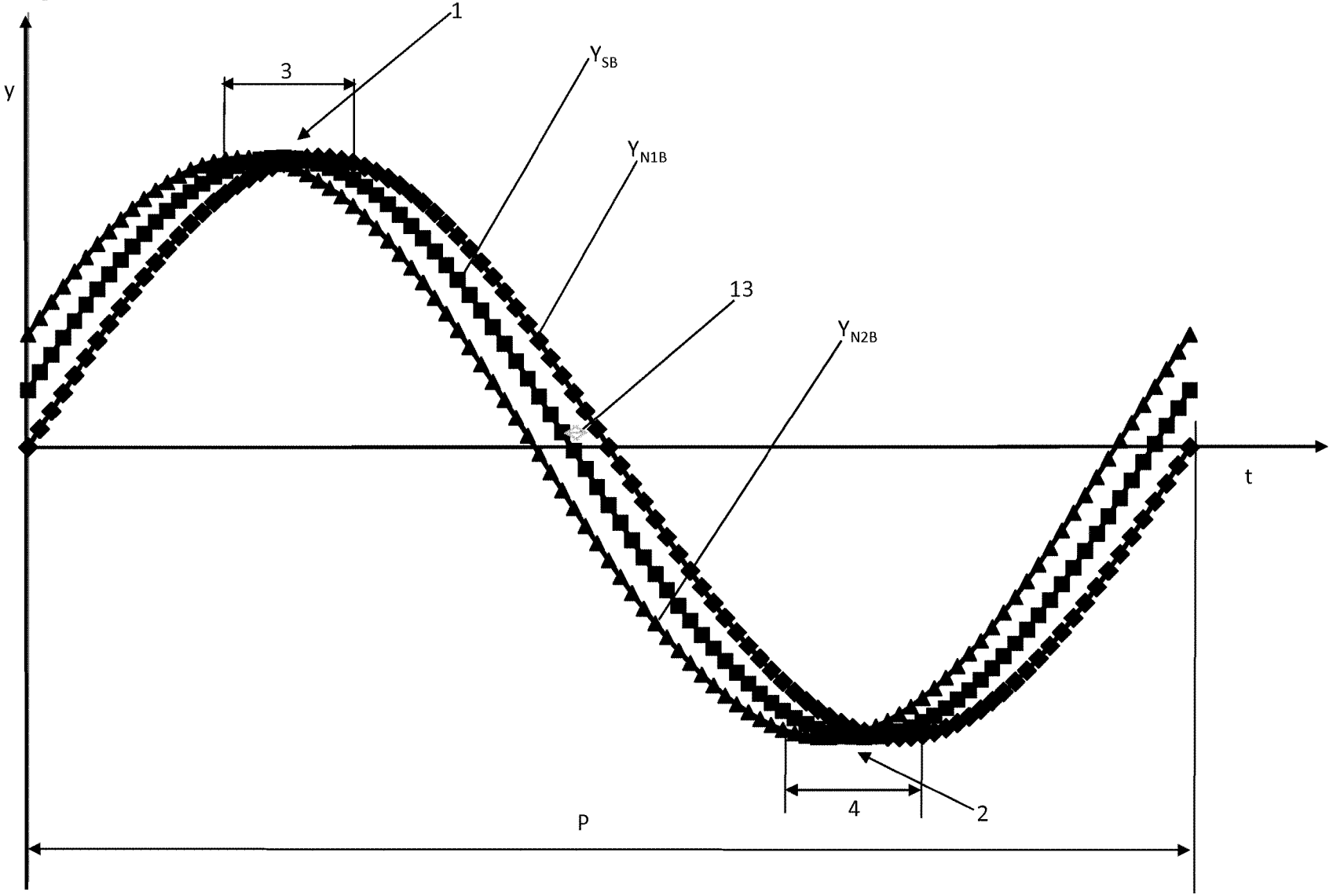
FIG. 13 shows three graphs on the longitudinal position of the spacer and the two adjacent system components with regard to the needle bed.

FIG. 13 shows three graphs $Y_{N1B}$, $Y_{SB}$, $Y_{N2B}$ on the longitudinal position of the spacer 10 and the two adjacent system components 11, 12 with regard to a needle bed 14. These three graphs describe one period of the movement of each of the elements 10, 11 and 12. In this context, the phrase "period" means the period of time which these elements need to reach the same point in the longitudinal direction of the grooves/shanks, in which the period started for the second time. The person skilled in the art would call the length of such a period 27 with regard to a harmonic function. Usually, such a period is different from the whole cam track of an element in a knitting machine: In circular knitting machines the element—or its butt—is moved along the cam track until it—or its butt—reaches the same position in the knitting machine. In flat knitting machines the cam holder which can be fixed on a carriage is moved until it reaches the same position and therefore the same element 10, 11, 12 for the second time. Usually a cam track includes a plurality of periods.

In the case shown in FIG. 13 all three elements (spacer 10, first needle 11 and second needle 12) perform the same movements with a short delay of time 13. The three graphs $Y_{N1B}$, $Y_{SB}$, $Y_{N2B}$ reach maxima 1 and minima 2 successively.

Such movements are advantageous for all embodiments of the invention. One beneficial way to transfer the force for the movements to the elements involved is to provide the elements 10, 11 and 12 with butts 17 and move the needle bed 14 with respect to cams 18 which transfer force to the butts. In the case shown in FIG. 14 ("all elements perform the same movements") all elements can interact with the same group of cams. This means all elements could have the same cam track.

The movements of the aforementioned elements 10, 11 and 12 can be in accordance with a harmonic function of time like sinus or cosinus. FIG. 13 only shows one period P of the movements of the aforementioned three elements 10, 11 and 12. A comparison of the three graphs $Y_{N1B}$, $Y_{SB}$, $Y_{N2B}$ also clarifies that their movement has the same direction during most of the time period P. This is very advantageous for all inventive embodiments since the reduction of the relative velocity between these three adjacent elements (in comparison with a immovable wall 15 which delimits two adjacent grooves 16 of a state-of-the-art needle bed) leads to a lower friction between them. On this basis, it seems sensible to presume that the friction between two adjacent elements (like the spacer 10 and one of the system components 11 or 12) is reduced during one same period P if their movement has the same direction for at least half of the same period P of movement.

FIG. 13 also shows that there are periods of time 3 and 4 in which the movements of the three elements 10, 11 and 12 do not always have the same direction. These periods of time comprise the points of time 1 and 2 in which each of the three elements 10, 11 and 12 reach the minimum and maximum of their respective movement in the longitudinal direction y.

Figure 14:
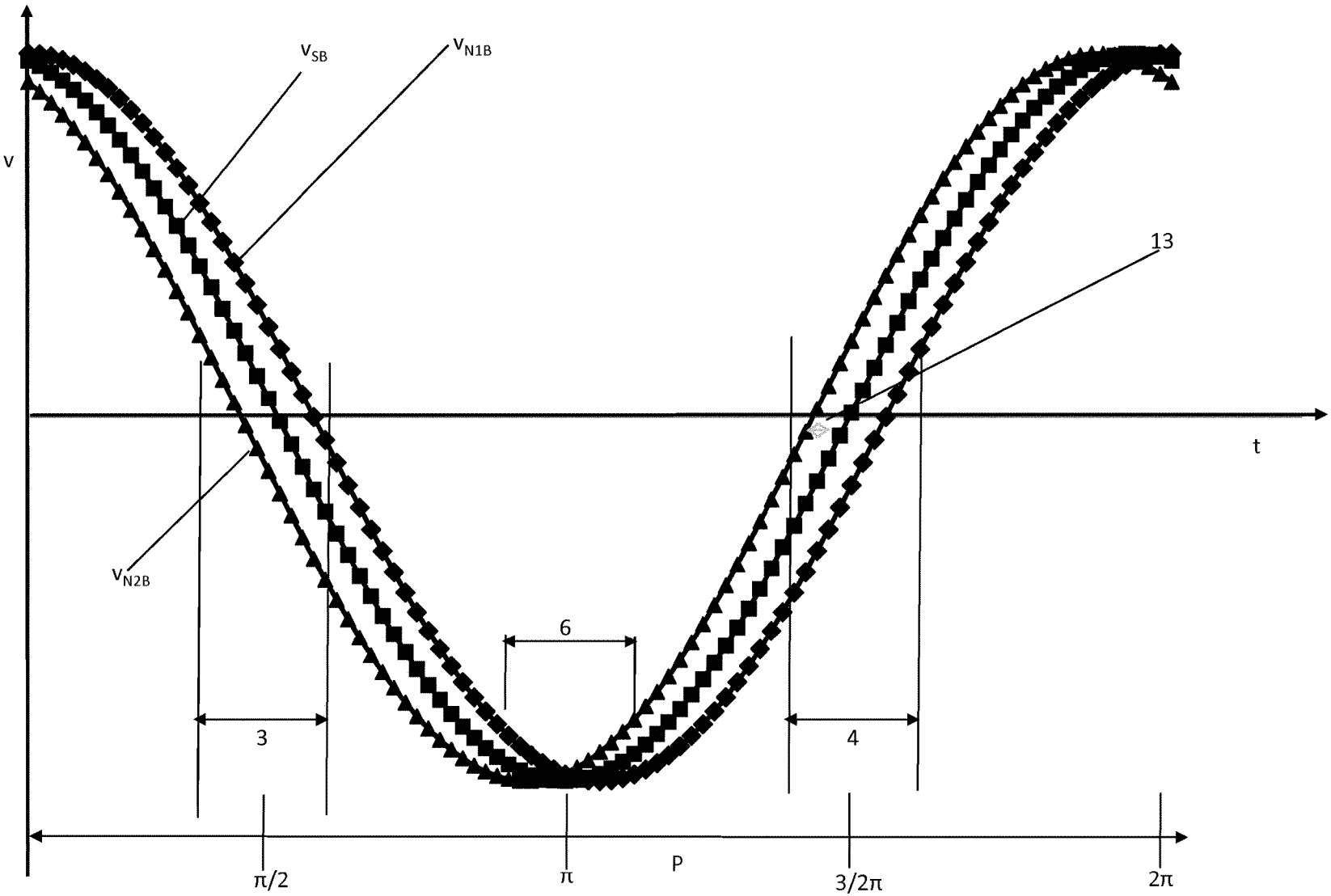
FIG. 14 shows three graphs on the relative velocity of the spacer and the two adjacent system components with regard to the needle bed.

FIG. 14 shows the same movements as FIG. 13. However, the three graphs shown in FIG. 13 represent the relative velocities $V_{SB}$, $V_{N1B}$, $V_{N2B}$ of the three elements 10, 11, 12 with regard to the needle bed 14 and not their position in the longitudinal direction y. The aforementioned velocities $V_{SB}$, $V_{N1B}$, $V_{N2B}$ are the derivatives of the positions $Y_{N1B}$, $Y_{SB}$, $Y_{N2B}$ of these elements with respect to time t. The derivative of a harmonic function of time is once again a harmonic function with a phase shift of $\pi/2$ in comparison to the original function (the present publication shall deal with the aforementioned graphs or functions as if they were purely harmonic ones).

Figure 15:
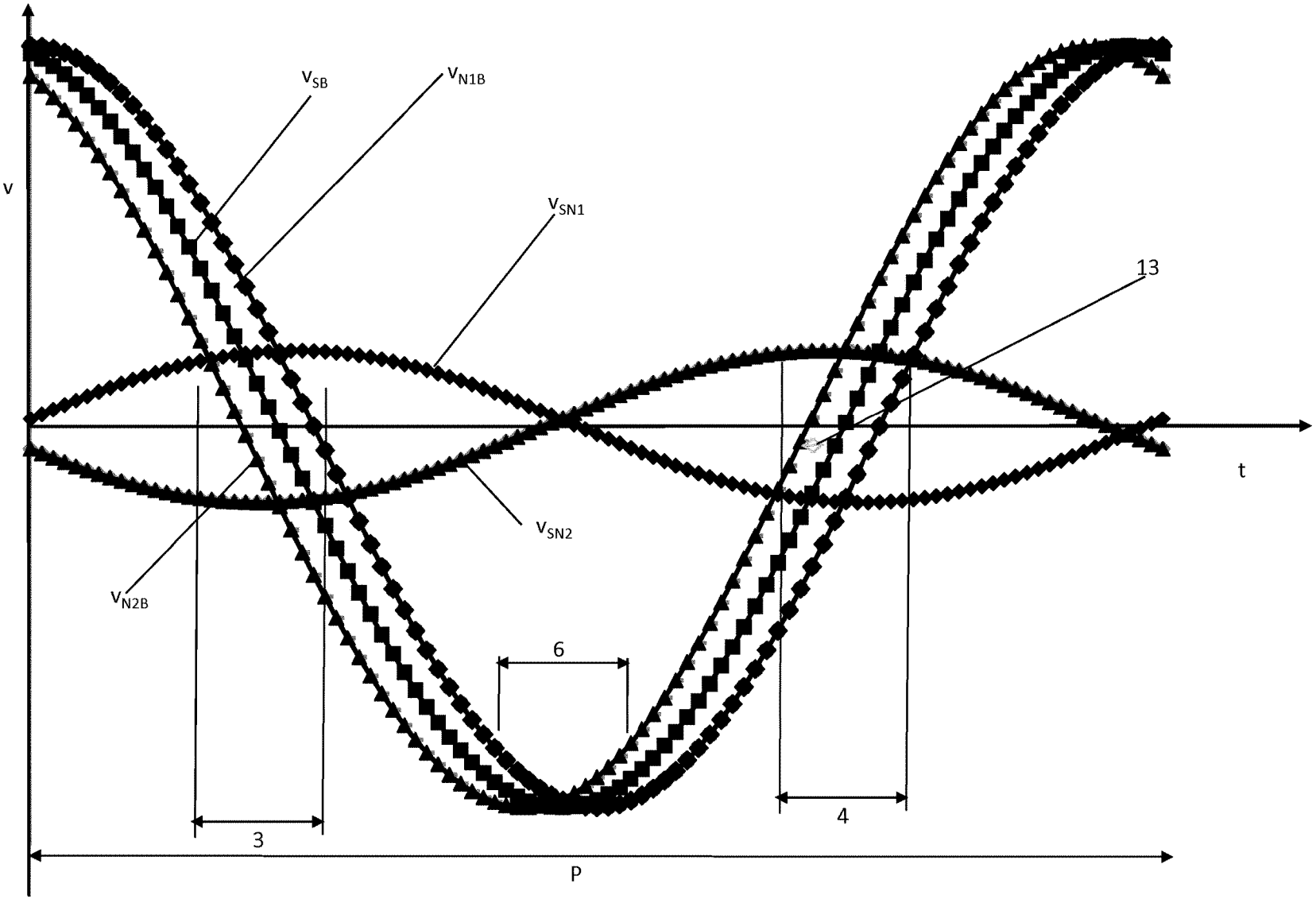
FIGS. 15 shows five graphs. Three ones on the relative velocity of the aforementioned elements towards the needle bed and two ones on the relative velocity of the spacer towards the two adjacent system components.

FIG. 15 shows the same three graphs on the relative velocities $V_{SB}$, $V_{N1B}$ and $V_{N2B}$. FIG. 15 additionally shows two further graphs $V_{SN1}$ and $V_{SN2}$ which describe the relative velocities of the spacer 10 with respect to the first needle 11 and the spacer 10 with respect to the second needle 12 (in this case the two adjacent system components are simply called needles, and the first needle is the first needle to reach a certain point like an extrema 1 or 2).

The relative velocities $V_{SN1}$ and $V_{SN2}$ between the elements 10, 11, 12 are relatively low in comparison with the relative velocities between the elements 10, 11, 12 and the needle bed 14. As already mentioned before, this fact leads to a reduction of the friction between the elements 10, 11, 12 in comparison with a state-of-the-art needle bed which is provided with immovable walls 15 instead of a spacers 10. Therefore, inventive embodiments can save energy.

Figure 16:
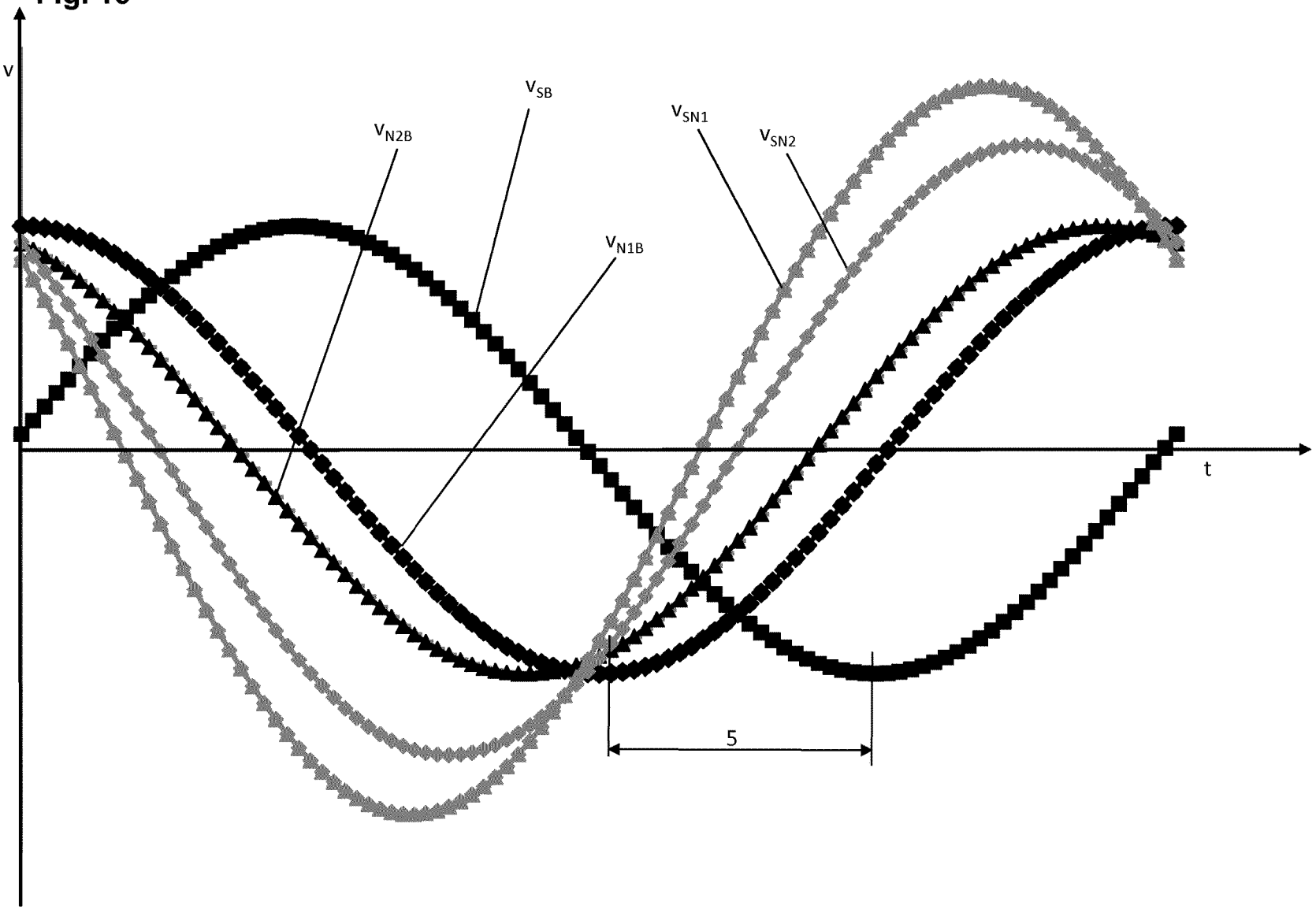
FIG. 16 shows once again the five graphs shown in FIG. 4 under different circumstances.

FIG. 16 also shows five graphs on the already mentioned relative velocities $V_{SB}$, $V_{N1B}$, $V_{N2B}$, $V_{SN1}$ and $V_{SN2}$. However, the movement $V_{SB}$ of the spacer 10 with regard to the needle bed 14 has been subject to a shift relative to the relative movements $V_{N1B}$ and $V_{N2B}$ of the two needles with regard to the same needle bed 14: the spacer 10 reaches the extrema 1, 2 of its movement considerably later than the needles. This "distance" or "period of time" between the extrema 1, 2 of the respective elements is indicated by the arrow 5.

Surprisingly, tests have shown that such a shift of the movements of spacer 10 and adjacent system components 11, 12 has its advantages. The gist of this measure is to prevent neighbouring elements 10, 11, 12 from resting with regard to each other. Such a rest can for example take place in the period of time 6 in the case of movement shown in FIGS. 13-15. During this time period the velocities $V_{SN1}$ and $V_{SN2}$ of each of the elements 10-12 are low and even reach nil.

Figure 17:
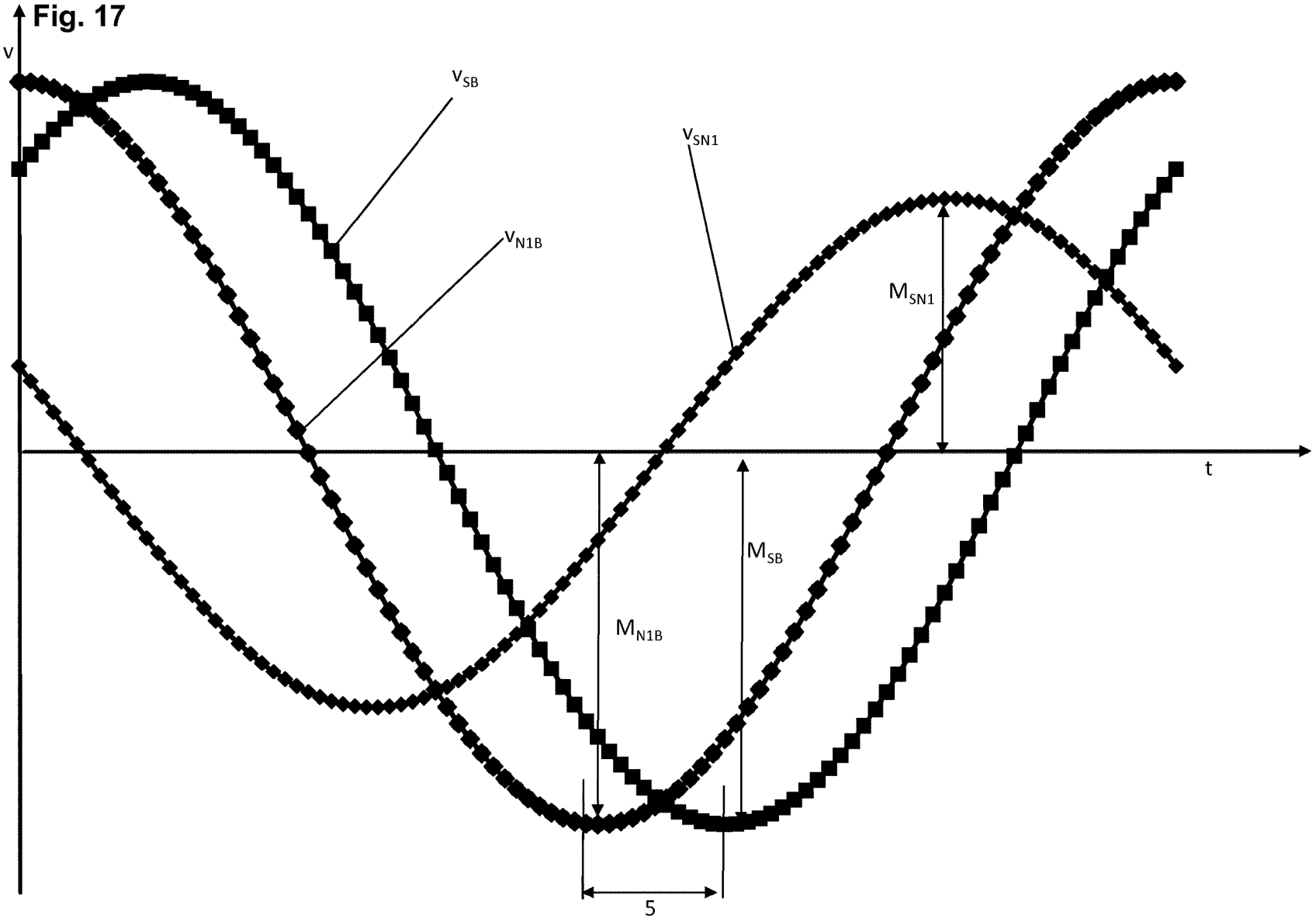
FIG. 17 only shows three of the aforementioned five graphs under different circumstances.

This rest can necessitate a higher force in order to restart the respective relative movement of these elements (stick slip effect). FIG. 17 only shows three graphs VN1s, Vss and VsN1—In the case shown in FIG. 17 the "distance" 5 between the extrema 1 and 2 of the movements Vss and VsN1 is much smaller than in FIG. 16. As a result, the relative velocity VsN1 between spacer 10 and first needle 11 is lower than in FIG. 16. The magnitude MsN1 of the extrema of the velocity VsN1 is also lower than the magnitudes MN1s and Mss of the extrema of the relative velocities VNrn and Vss of the elements 10 and 11 with regard to the needle bed 14. Movements of the kind shown in FIG. 17 have proven to be energy-saving.

Therefore it is advantageous for all inventive embodiments, if the magnitude $M_{N1B}$ and/or $M_{N2B}$ of the extrema of the movement of at least one of the two adjacent needles with regard to the needle bed is lower than the magnitude $M_{SN1}$ of the extrema of the relative movement of the spacer 10 with respect to the respective system component 11, 12.

As mentioned above FIGS. 16 and 17 show movements of the spacer 10 and its adjacent system components 11 and 12 which are shifted so that the extrema of the movements $V_{N1B}$, $V_{N2B}$ of the system components 11 and 12 and the extrema of the movement $V_{SB}$ of the spacer 10 relative to the needle bed 14 have a distance 5. This distance is not only a delay 13 like in FIGS. 13-15.

If the force for the movements shown in the first three figures is provided by cams, the delay 13 is simply the delay (time difference) with which two adjacent elements pass through the same cam.

If the force for the movements shown in FIGS. 16 and 17 is also provided by cams 18 which are not moved with respect to the machine frame of a knitting machine but with a rotating needle bed 14 which carries elements 10, 11, 12 with butts 17 the distance 5 can be implemented in the following way.

The butts 17 of the spacers 10 and the butts of the system components 11, 12 are driven through the passages 35 of different groups of cams 18. As a result the spacers 10 and the system components 11, 12 have different cam tracks. The "distance or phase difference" 5 is caused by the distance (preferably in x-direction) of the extrema 37 of the different passages 35 (see FIGS. 13 and 15) through which the butts 17 of spacers 10 and system components 17 are driven. In this context, the distance 5 in the direction of the width of the channel or grooves 16 of the needle bed 14 is decisive for the magnitude or length of the phase difference 5. In FIGS. 16 and 17 this distance is also shown as a time difference.

The aforementioned way to drive the elements is really one advantageous way to provide force for the loop-forming process: Two different groups of cams 18 are provided per system. One group interacts with the butts 17 of the system components 11, 12 and another group interacts with the butts 17 of the at least one spacer 10.

As already mentioned before, the above described details of different movements can be performed with benefit by all inventive embodiments.

Figure 18:
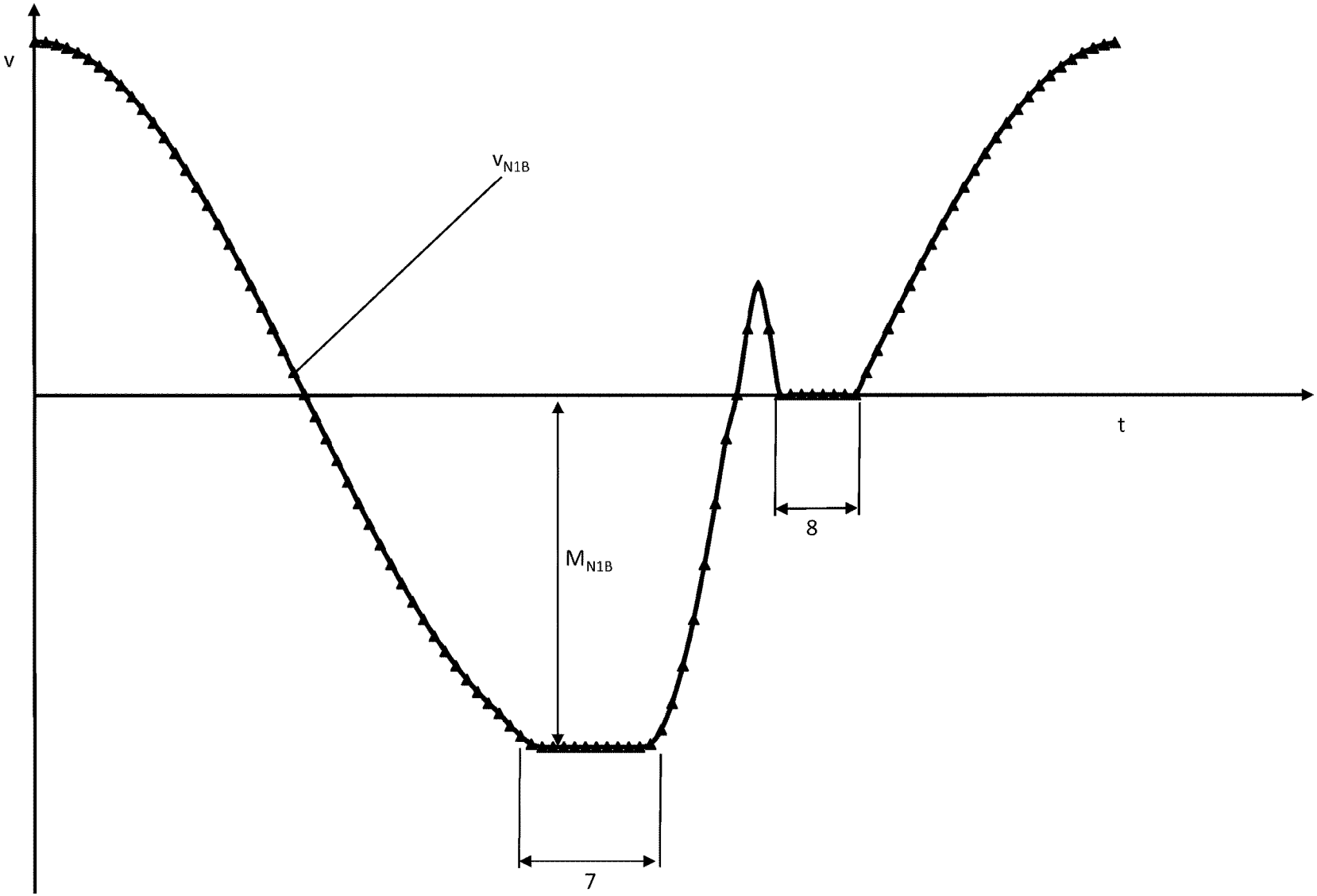
FIG. 18 shows one graph which is not a purely harmonic function.
Figure 19:
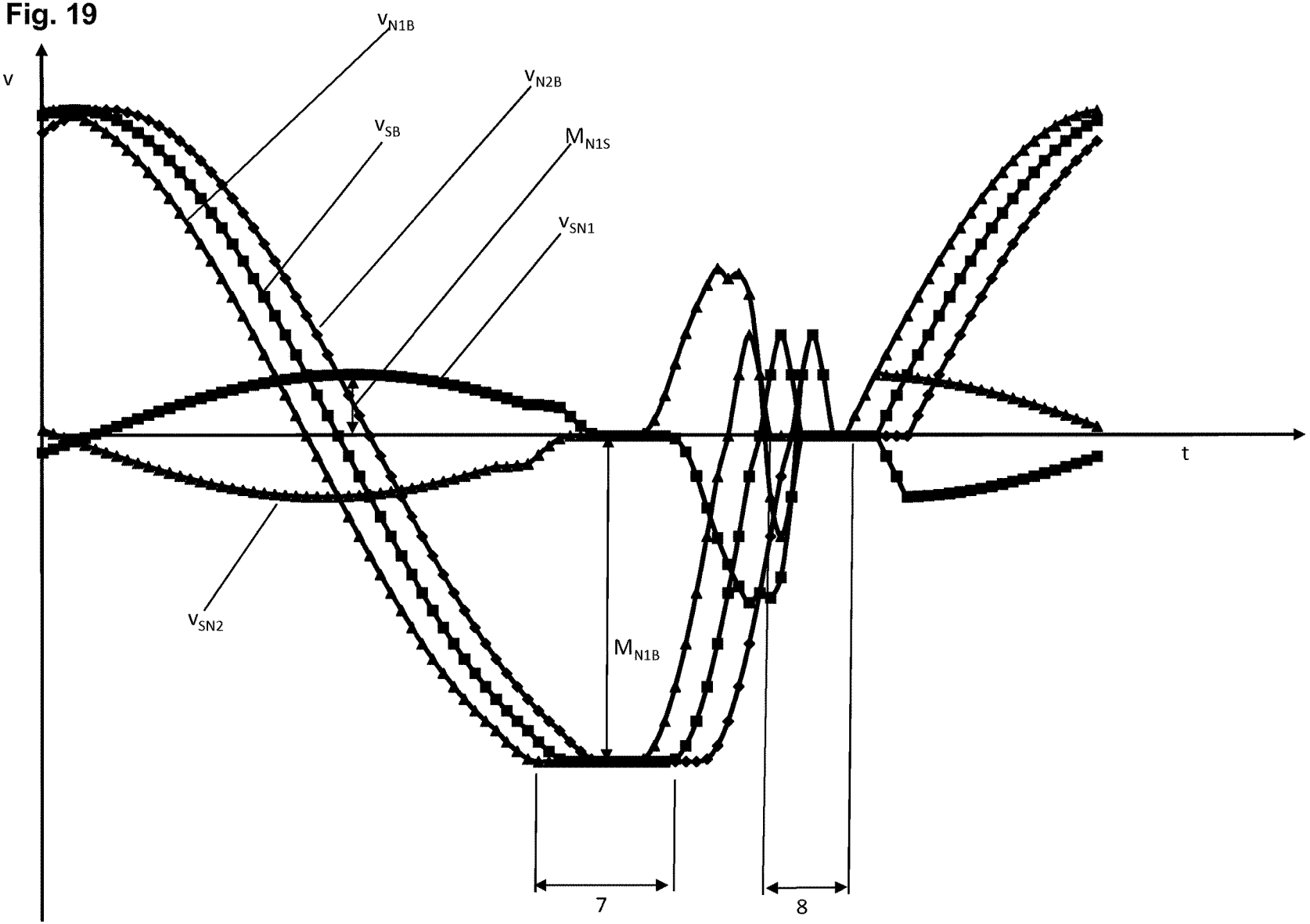
FIG. 19 shows three graphs of the kind shown in FIG. 19.

FIGS. 18 and 19 further elucidate the role of the so-called stick slip effect which was already mentioned above. Both figures show graphs on the relative velocity v of the elements 10, 11, 12 versus time in a realistic scenario in which the respective velocities are clearly not a purely harmonic function of the second direction x. FIG. 18 only shows one graph of the relative velocity $V_{N1B}$ of a first needle 11 with regard to the needle bed 14. In the present context, the phases 7 and 8 of the movement of this needle 11 are without a relative acceleration with regard to the needle bed 14. These zones are of special interest. The first zone 7 of this kind is part of the retreating movement of the respective needle 11. The second zone 8 denotes a standstill at the beginning of the propulsion movement of the needle. In both zones 7, 8 there is no acceleration relative to the needle bed 14.

FIG. 19 shows five graphs on the relative velocities which occur in a groove equipped with the first needle 11, a spacer 10 and a second needle 12 (compare with FIGS. 1, 4 and 5) when all aforementioned elements are driven through one cam track which is the same one as the cam track which is the basis of the velocity $V_{N1B}$ of the needle 11 which is shown in FIG. 18. FIG. 19 shows that there is an overlap between the different zones 7, 8 with no acceleration with regard to the needle bed. As a result two other zones arise in which there is no relative velocity $V_{SN1}$ and $V_{SN2}$ between the first needle and the spacer and between the second needle and the spacer. These zones could give rise to a stick slip effect between these directly adjacent elements 10, 11 and 10, 12. There are some alternative movements which may avoid this effect and which therefore help to save energy.

The spacer's 10 movement can be different from the movement performed by the needles 11, 12. "Different" means that there can be a shift between the extrema of the movements of the needles 11, 12 and spacer as already discussed above. But there are other possibilities: the spacer can perform a different movement which is to say it can perform movements which do not stop with regard to the other two elements 11, 12. Therefore the spacer can follow a cam track which is formed in a different way than the cam track of its adjacent system components 11, 12. Another possibility is to let the spacer start its relative acceleration with regard to the needle bed 14 at an earlier moment in time (or at another point in the second direction x) than the adjacent system components 11, 12. An earlier start of the spacer's acceleration is advantageous in this context for all embodiments.

Figure 20:
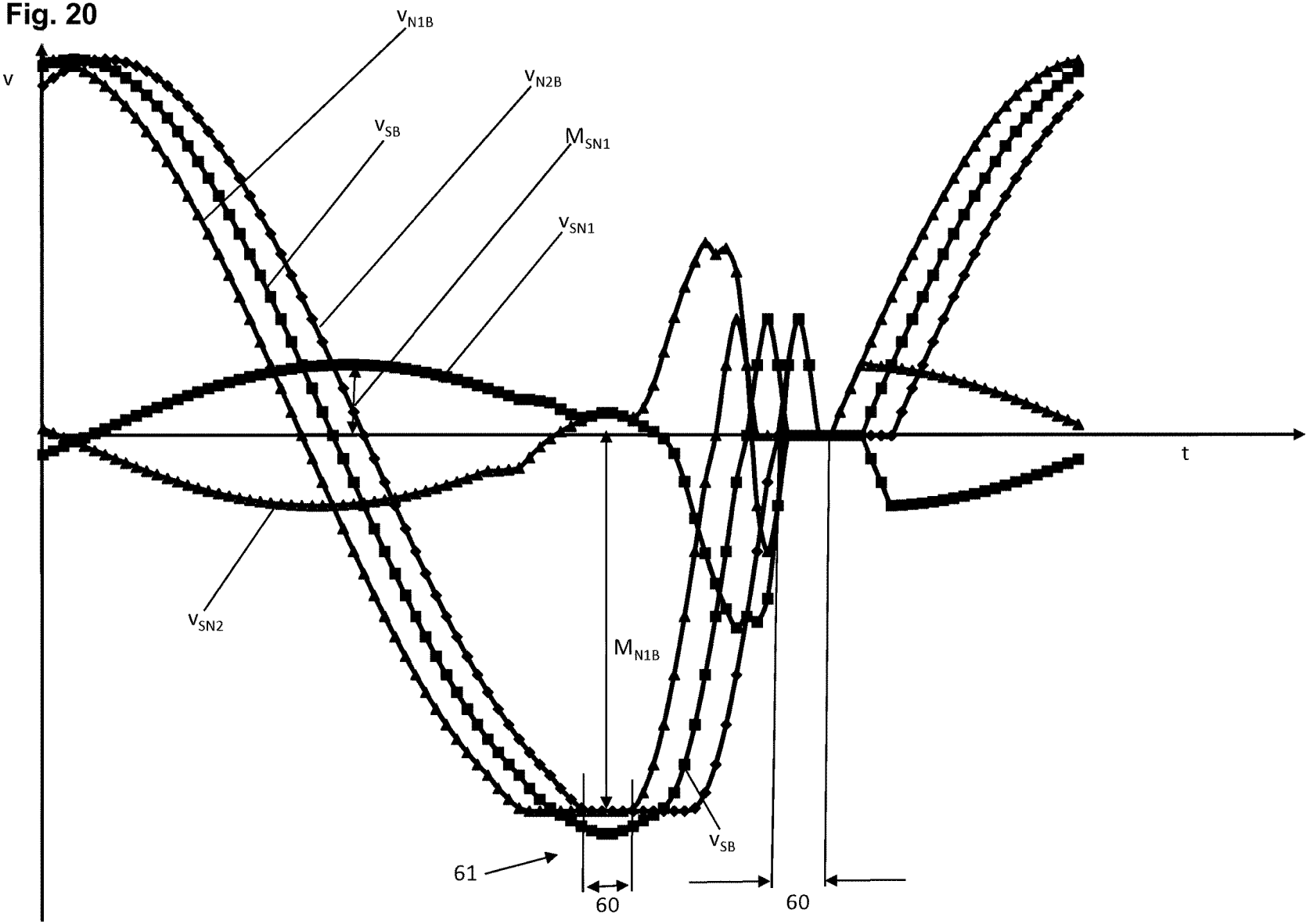
FIG. 20 shows three of the graphs shown in FIG. 19 whereby the graph VSB is slightly modified in zone 60.

In summary, the most advantageous measure in this context takes place in the phases 60. In these phases there is no relative acceleration of the two adjacent system components 11, 12 of one groove. In at least one of these phases the spacer 10 is provided with a relative acceleration with regard to the system components 11, 12. FIG. 20 is based on FIG. 19 and provides an example for this measure.

In the first phase 60 shown in FIG. 20 (the left hand one) the spacer 10 performs a movement (see pointer 61) which is considerably different from the movement of its two adjacent system components 11, 12. This movement is possible since the spacer 10 does not take part in the loop forming process. Moreover, the spacer's extension may be considerably shorter in y direction than the extension of the system components 11, 12. It is advantageous if the spacers are present in segments of the longitudinal extension of the system components in which their butts are situated. It is also advantageous if the length of the spacers 10 is at least 90, 80, 70 or 60% of the system components 11, 12 lengths. Measures of the kind described before are advantageous with regard to any inventive embodiment.

FIGS. 13 to 20 include diagrams in which the elements' longitudinal position y or the elements' velocity in the longitudinal direction y is shown as a function of time t. The graphs of these diagrams could have exactly or nearly the same shape if the elements' longitudinal position y or the elements' velocity in the longitudinal direction y would have been shown as a function of the respective elements' position in the direction x. This statement applies above all with regard to circular knitting machines.

| List of numerals | |
|---|---|
| 1 | Minima/Extrema |
| 2 | Maxima/Extrema |
| 3 | Period of time in which the movements $Y_{SB}$, $Y_{N1B}$, $Y_{N2B}$ do not have the same direction |
| 4 | Period of time in which the movements $Y_{SB}$, $Y_{N1B}$, $Y_{N2B}$ do not have the same direction |
| 5 | Arrow signifying the distance or period of time between the position where the at least one spacer reaches its minima and maxima and the position where the system components reach their minima and maxima. Both positions are relative to the machine frame which is fixed. |
| 6 | Period of time with low relative velocity between the elements 10-12 |
| 7 | First zone without relative acceleration with regard to the needle bed |
| 8 | Second zone without relative acceleration with regard to the needle bed |
| 9 | |
| 10 | Spacer/element |
| 11 | First Needle/element/system component |
| 12 | Second Needle/element/system component |
| 13 | Arrow signifying the delay of time between first needle and spacer |
| 14 | Needle bed |
| 15 | Immovable wall which delimits two grooves of a needle bed |
| 16 | Groove/channel for guiding elements |
| 17 | Butt of the elements |
| 18 | Cams |
| 19 | Loop-forming zone |
| 20 | hook |
| 21 | Distance between the needles 11 and 12 |
| 22 | Holding device which limits the spacers' movements |
| 23 | Yarn/Thread |
| 24 | Latch |
| 25 | Sinker |
| 26 | Saw slot |
| 27 | Pivot of the latch |
| 28 | Tooth of the needle bed/slot |
| 29 | |
| 30 | |
| 31 | Movement limitation recess |
| 32 | Movement limitation butt |

-continued

| List of numerals | |
|---|---|
| 33 | Bracket signifying the extension of a loop |
| 34 | Right hand side surface of the spacer 10 shown in FIG. 8 on the right side |
| 35 | Passage for the butts 17 in the cam 18 |
| 36 | |
| 37 | Extrema of a passage 35 (in y-direction) |
| 39 | Shank of a system component |
| 52 | distance between the centers of the hooks 20 of two adjacent system components, pitch |
| 53 | Symmetry line |
| 55 | Bottom of a groove |
| 60 | phase without relative acceleration between the two adjacent system components |
| 61 | Pointer which denotes a phase in which the spacer is moved different than the system components |
| $Y_{SB}$ | Longitudinal position y of the spacer relative to the needle bed |
| $Y_{N1B}$ | Longitudinal position y of the first needle relative to the needle bed |
| $Y_{N2B}$ | Longitudinal position y of the second needle relative to the needle bed |
| $V_{SB}$ | Longitudinal velocity v of the spacer relative to the needle bed |
| $V_{N1B}$ | Longitudinal velocity v of the first needle relative to the needle bed |
| $V_{N2B}$ | Longitudinal velocity v of the second needle relative to the needle bed |
| $V_{SN1}$ | Longitudinal velocity v of the spacer relative to the first needle |
| $V_{SN2}$ | Longitudinal velocity v of the spacer relative to the second needle |
| P | Period |
| t | Time |
| x | Direction of the width of the shanks of the elements/grooves |
| y | Direction of the length of the shanks of the elements/grooves |
| z | Direction of the height of the shanks of the elements/grooves |
| v | velocity |
| $M_{SB}$ | Magnitude of the extrema of the longitudinal velocity v of the spacer relative to the needle bed |
| $M_{N1B}$ | Magnitude of the extrema of the longitudinal velocity v of the first needle relative to the needle bed |
| $M_{SN1}$ | Magnitude of the extrema of the longitudinal velocity v of the spacer relative to the first needle |

The invention claimed is:

1. A loop-forming process comprising:

moving a plurality of system components relative to a needle bed (14), said system components contacting threads (23) for forming loops, placing at least one spacer (10) between at least two adjacent system components of said plurality of system components to define a distance (21) between said two adjacent system components, the at least one spacer (10) overlapping said two adjacent system components in a longitudinal direction of said at least one spacer (10), the at least one spacer (10) being in mechanical contact with said two adjacent system components, moving said at least one spacer (10) with respect to the needle bed (14), moving the at least one spacer (10) with respect to both said at least two adjacent system components at least for a period of time during the loop forming process, wherein said at least one spacer (10) is placed away from and does not contact threads.

2. The loop-forming process according to claim 1 further comprising at least temporarily moving the at least one spacer (10) during the loop-forming process with a first relative velocity (Vsb) with respect to the needle bed (14), with a second relative velocity (VsN1) with respect to a first of the at least two system components (11), and with a third relative velocity (VsN2) with respect to a second of the at least two system components (12).

3. The loop-forming process according to claim 2 further comprising:

performing periodic movements with the at least one spacer (10) and the at least two adjacent system components relative to the needle bed (14) during which the at least one spacer (10) and the at least two adjacent system components reach minima (1) and maxima (2) in a length-direction (y) of the at least two adjacent system components' shanks, the movements relative to the needle bed (14) have periods (P) of time moving between respective minima (1) and maxima (2) with a same duration, and wherein the first relative velocity (Vsb) is higher than or equal to one or both of the second relative velocity (VsN1) and the third relative velocity (VsN2) during at least 85% of the duration of the periods (P).

4. The loop-forming process according to claim 1 further comprising providing force for the at least one spacer's (10) movement by at least one cam (18) which is moved relative to the needle bed (14).

5. The loop-forming process according to claim 1 further comprising performing same relative movements with the at least one spacer (10) and the at least two adjacent system components with respect to the needle bed (14) whereby the at least one spacer (10) and the at least two adjacent system components perform the relative movements with a delay.

6. The loop-forming process according claim 1 further comprising the at least one spacer (10) and the at least two adjacent system components successively receiving force for their relative movements from a same at least one cam (18).

7. The loop-forming process according to claim 5 further comprising the at least one spacer (10) receiving force for its relative movements from at least one cam (18) which does not provide the at least two adjacent system components with force for their relative movements.

8. The loop-forming process according to claim 1 further comprising:

the at least one spacer and the at least two adjacent system components performing movements which have minima (1) and maxima (2) in a length direction (y) of the at least two adjacent system components' shanks, moving the needle bed (14) relative to a cam holder, and the at least one spacer (10) reaching at least one minima (1) and maxima (2) at a position different from the minima (1) and the maxima of the at least two adjacent system components.

9. The loop-forming process according to claim 1 further comprising the at least one spacer (10) receiving force for its relative movements from at least one of the at least two adjacent system components.

10. The loop-forming process according to claim 1 further comprising:

the at least two adjacent system components performing movements with regard to the needle bed (14) movements which comprise phases (60) in which the at least two adjacent system components have no acceleration with regard to each other, and at least temporarily accelerating the at least one spacer (10) which is placed between the at least two adjacent system components with regard to the at least two adjacent system components during at least one of the phases (60).

11. The loop-forming process according to claim 1 further comprising the at least one spacer (10) not controlling directly or indirectly via another element the movement of loop forming portions (20) which take part in the loop forming process.

12. A device for loop-forming, comprising:

a needle bed (14), a plurality of system components comprising portions configured to engage in loop-forming and being involved in loop-forming at least for a period of time during a loop forming process, said plurality of system components being movably arranged in said needle bed (14), at least one spacer (10) arranged between at least two adjacent system components of said plurality of system components and configured to define a distance between said at least two adjacent system components the at least one spacer (10) overlapping said two adjacent system components in a longitudinal direction of said at least one spacer (10) and being in mechanical contact with said at least two adjacent system components, whereby said at least one spacer (10) is devoid of loop-forming structure (20, 24), whereby said at least one spacer (10) is movably arranged in said needle bed (14), wherein said at least one spacer (10) is also movably arranged with respect to both of said at least two adjacent system components.

13. The device for loop-forming according to claim 12 further comprising a number of said plurality of system components which is higher than two and a number of the at least one spacer (10) which is higher than one.

14. The device for loop-forming according to claim 12 further comprising at least two grooves (16) configured to accommodate the at least one spacer (10) and said plurality of system components whereby the two grooves (16) are delimited by a wall (15) which is as broad in a direction of the grooves' (16) width as a shank of the at least one spacer (10).

15. The device for loop-forming according to claim 14 further comprising at least one means (31, 32) for limiting movement of the at least one spacer (10) in a length direction (y) of the grooves (16).

16. The device for loop-forming according to claim 12 further comprising at least one groove (16) which has a width which is equal to or bigger than 0.8 times a pitch (52) of the respective needle bed (14) and which has a length bigger than 60% of the plurality of system components' length.

17. The device for loop-forming according to claim 12 wherein the at least one spacer (19) is devoid of means for guiding or establishing mechanical contact with the plurality of system components or with a further member configured to control the plurality of system components.

18. The device for loop-forming according to claim 12 wherein the at least one spacer (10) is devoid of recesses, protrusions, or juts configured to guide or establish mechanical contact with the plurality of system components or with a further member configured to control the plurality of system components.

* * * * *